US008931569B2

(12) United States Patent
Fagley, IV et al.

(10) Patent No.: US 8,931,569 B2
(45) Date of Patent: Jan. 13, 2015

(54) METHOD AND APPARATUS FOR A WELLBORE ASSEMBLY

(75) Inventors: Walter Stone Thomas Fagley, IV, Katy, TX (US); Gary Duron Ingram, Richmond, TX (US); Paul James Wilson, Aledo, TX (US); Simon John Harrall, Houston, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 494 days.

(21) Appl. No.: 12/939,873

(22) Filed: Nov. 4, 2010

(65) Prior Publication Data

US 2011/0108285 A1 May 12, 2011

Related U.S. Application Data

(60) Provisional application No. 61/258,847, filed on Nov. 6, 2009.

(51) Int. Cl.

| | |
|---|---|
| ***E21B 23/08*** | (2006.01) |
| ***E21B 34/10*** | (2006.01) |
| ***E21B 23/06*** | (2006.01) |
| ***E21B 23/04*** | (2006.01) |

(52) U.S. Cl.

CPC ..... *E21B 23/06* (2013.01); *E21B 23/04* (2013.01); *E21B 23/065* (2013.01)

USPC ..... 166/383; 166/374; 166/63

(58) Field of Classification Search

USPC ..... 166/300, 374, 383, 63

See application file for complete search history.

(56) References Cited

U.S. PATENT DOCUMENTS

| | | | | |
|---|---|---|---|---|
| 3,266,575 | A | 8/1966 | Owen | |
| 3,282,342 | A | 11/1966 | Mott | |
| 3,426,846 | A | 2/1969 | Young | |
| 3,520,360 | A | 7/1970 | Kisling, III | |
| 3,612,088 | A * | 10/1971 | McBurnett | 137/116.3 |

(Continued)

FOREIGN PATENT DOCUMENTS

| | | |
|---|---|---|
| EP | 1 138 872 | 10/2001 |
| EP | 1 149 980 | 1/2002 |

(Continued)

OTHER PUBLICATIONS

Canadian Office Action for Application No. 2,720,076 dated Apr. 4, 2012.

(Continued)

*Primary Examiner* — Cathleen Hutchins

(74) *Attorney, Agent, or Firm* — Patterson & Sheridan, LLP

(57) ABSTRACT

A method and apparatus for a wellbore assembly. The wellbore assembly may comprise a conveyance member including at least one of a continuous spooled rod, a wireline, and a slickline; an accumulator system connected to the conveyance member; and a setting tool connected to the accumulator system. The accumulator system may be configured to supply a fluid pressure to actuate the setting tool. A method of operating a wellbore tool may comprise lowering a wellbore assembly into a wellbore using a conveyance member including at least one of a continuous spooled rod, a wireline, and a slickline, wherein the wellbore assembly includes an accumulator system and a setting tool. The method may comprise actuating the accumulator system to provide a fluid pressure to the setting tool. The method may comprise actuating the setting tool using the fluid pressure.

54 Claims, 14 Drawing Sheets

(56) References Cited

U.S. PATENT DOCUMENTS

| | | | | |
|---|---|---|---|---|
| 3,800,876 | A * | 4/1974 | Eggleston | 166/301 |
| 3,853,177 | A | 12/1974 | Mott | |
| 4,361,188 | A | 11/1982 | Russell | |
| 4,375,239 | A * | 3/1983 | Barrington et al. | 166/336 |
| 4,519,414 | A | 5/1985 | Anaya | |
| 4,527,415 | A | 7/1985 | Chabat-Courrede | |
| 4,589,440 | A | 5/1986 | Panet | |
| 4,705,259 | A | 11/1987 | Dolhen et al. | |
| 4,756,334 | A | 7/1988 | Panet et al. | |
| 4,791,992 | A | 12/1988 | Greenlee et al. | |
| 4,834,175 | A | 5/1989 | Ross et al. | |
| 4,840,231 | A | 6/1989 | Berzin et al. | |
| 5,101,907 | A | 4/1992 | Schultz et al. | |
| 5,207,272 | A | 5/1993 | Pringle et al. | |
| 5,240,077 | A | 8/1993 | Whitsitt | |
| 5,404,946 | A | 4/1995 | Hess | |
| 5,597,040 | A | 1/1997 | Stout et al. | |
| 5,791,412 | A | 8/1998 | Myhre | |
| 6,012,518 | A | 1/2000 | Pringle et al. | |
| 6,095,249 | A | 8/2000 | McGarian et al. | |
| 6,341,654 | B1 | 1/2002 | Wilson et al. | |
| 6,364,017 | B1 | 4/2002 | Stout et al. | |
| 6,367,545 | B1 | 4/2002 | Van Buskirk et al. | |
| 6,523,856 | B2 | 2/2003 | Braun et al. | |
| 6,601,648 | B2 | 8/2003 | Ebinger | |
| 6,651,749 | B1 | 11/2003 | Kilgore | |
| 6,695,057 | B2 | 2/2004 | Ingram et al. | |
| 6,776,238 | B2 | 8/2004 | Dusterhoft et al. | |
| 6,883,610 | B2 | 4/2005 | Depiak | |
| 6,886,631 | B2 | 5/2005 | Wilson et al. | |
| 7,055,598 | B2 | 6/2006 | Ross et al. | |
| 7,066,263 | B1 | 6/2006 | Mouton | |
| 7,114,558 | B2 | 10/2006 | Hoffman et al. | |
| 7,134,488 | B2 | 11/2006 | Tudor et al. | |
| 7,172,028 | B2 | 2/2007 | Barbee et al. | |
| 7,243,727 | B2 | 7/2007 | Tudor et al. | |
| 7,363,860 | B2 | 4/2008 | Wilson et al. | |
| 7,559,361 | B2 | 7/2009 | Obrejanu | |
| 7,600,566 | B2 | 10/2009 | Hoffman et al. | |
| 7,617,880 | B2 | 11/2009 | Loughlin | |
| 7,665,527 | B2 | 2/2010 | Loretz | |
| 7,681,651 | B2 | 3/2010 | Loughlin | |
| 7,828,052 | B2 | 11/2010 | Obrejanu | |
| 7,836,962 | B2 | 11/2010 | Fagley, IV et al. | |
| 8,196,515 | B2 | 6/2012 | Streibich et al. | |
| 8,459,377 | B2 | 6/2013 | Moyes | |
| 2002/0074134 | A1 | 6/2002 | Cook et al. | |
| 2002/0121380 | A1 | 9/2002 | Doane et al. | |
| 2004/0007361 | A1 | 1/2004 | McGarian et al. | |
| 2004/0069496 | A1 | 4/2004 | Hosie et al. | |
| 2004/0069504 | A1 | 4/2004 | Krueger et al. | |
| 2005/0211446 | A1 | 9/2005 | Ricalton et al. | |
| 2006/0048949 | A1 * | 3/2006 | Murray | 166/383 |
| 2006/0124315 | A1 | 6/2006 | Frazier et al. | |
| 2006/0207763 | A1 | 9/2006 | Hofman | |
| 2006/0243440 | A1 | 11/2006 | Corbett et al. | |
| 2006/0278399 | A1 | 12/2006 | Dwivedi et al. | |
| 2007/0044672 | A1 * | 3/2007 | Smith | 102/201 |
| 2008/0060846 | A1 * | 3/2008 | Belcher et al. | 175/25 |
| 2009/0056956 | A1 | 3/2009 | Ingram | |
| 2009/0293977 | A1 | 12/2009 | Lauterbach | |
| 2010/0243254 | A1 | 9/2010 | Murphy et al. | |
| 2010/0243270 | A1 | 9/2010 | Ingram et al. | |

FOREIGN PATENT DOCUMENTS

| | | | |
|---|---|---|---|
| EP | 2085571 | A2 | 8/2009 |
| GB | 2 130 274 | | 5/1984 |
| GB | 2 300 870 | | 11/1996 |
| GB | 2347704 | A | 9/2000 |
| GB | 2 400 870 | | 10/2004 |
| GB | 2426016 | A | 11/2006 |
| GB | 2 438 955 | | 12/2007 |
| GB | 2 471 958 | | 1/2011 |
| WO | 94/09246 | A1 | 4/1994 |
| WO | 2004020774 | A2 | 3/2004 |
| WO | 2009/106875 | A2 | 9/2009 |

OTHER PUBLICATIONS

UK Search Report for Application No. GB1018752.4 dated Jan. 19, 2011.

GB Search Report for Application No. GB1018752.4 dated Mar. 7, 2011.

UK Examination Report for Application No. GB1018752.4 dated Nov. 21, 2013.

Canadian Office Action dated Jun. 14, 2013, Canadian Patent Application No. 2,720,076.

UK Examination Report dated Feb. 18, 2014, for Application No. GB1018752.4.

United Kingdom Combined Search and Examination Report dated Jul. 23, 2014 for Application No. GB1410519.1.

United Kingdom Examination Report dated Aug. 14, 2014, 2014 for Application No. GB1018752.4.

United Kingdom Examination Report dated Sep. 29, 2014 for Application No. 1018752.4.

United Kingdom Examination Report dated Sep. 29, 2014 for Application No. 1410519.1.

United Kingdom Combined Search and Examination Report dated Sep. 29, 2014 for Application No. 1414889.4.

United Kingdom Combined Search and Examination Report dated Sep. 29, 2014 for Application No. 1414890.2.

United Kingdom Combined Search and Examination Report dated Sep. 29, 2014 for Application No. 1414891.0.

* cited by examiner

METHOD AND APPARATUS FOR A WELLBORE ASSEMBLY

CROSS REFERENCE TO RELATED APPLICATIONS

This application claims benefit of U.S. Provisional Patent Application Ser. No. 61/258,847, filed Nov. 6, 2009, which is herein incorporated by reference in its entirety.

BACKGROUND OF THE INVENTION

1. Field of the Invention

Embodiments of the invention relate to a wellbore assembly that may be run in a wellbore using a spoolable line, such as a wireline, a slickline, or a continuous spooled rod, including COROD®. COROD® is a registered trademark of Weatherford International Ltd. and is herein defined as a coiled, solid conveyance. Embodiments of the invention relate to a wellbore assembly including an accumulator system configured to hydraulically actuate a setting tool. Embodiments of the invention relate to a wellbore assembly that may be run into a wellbore using slickline and includes an accumulator system and a setting tool configured to operate a wellbore tool, such as a packer, in the wellbore.

2. Description of the Related Art

It is often necessary to deploy and actuate wellbore equipment and tools, including packers and bridge plugs, during the completion or remediation of a well. Wellbore hardware may be deployed and actuated using various conveying members including drill pipe, coiled tubing, or spoolable line, such as wireline and slickline. Drill pipe and coiled tubing are physically larger and have greater strength than wireline and slickline. However, the cost and time requirements associated with procuring and running drill pipe or coiled tubing are much greater than those of spoolable line. Therefore, whenever appropriate, use of spoolable line is preferred.

Wireline and slickline are among the most utilized types of spoolable line. Wireline consists of a composite structure containing electrical conductors in a core assembly which is encased in spirally wrapped armor wire. Typically, wireline is used in applications where it facilitates the transportation of power and information between wellbore equipment and equipment at the surface of the well.

Slickline, on the other hand, is mainly used to transport hardware into and out of the well. Slickline, designed primarily for bearing loads, is of much simpler construction and does not have electrical conductors like those in wireline. Instead, slickline is a high quality length (sometimes up to 10,000 feet or more) of wire that can be made from a variety of materials (from mild steel to alloy steel) and can be produced in a variety of sizes. Typically, slickline comes in three sizes: 0.092; 0.108; and 0.125 inches in diameter. For larger sizes, a braided wire construction is utilized. The braided wire, for all practical purposes, has similar functional characteristics as a solid wire.

As stated above, use of spoolable line for deploying and actuating wellbore tools is preferred over the use of drill pipe and coiled tubing due to the relatively low expense. However, many of the wellbore tools deployed during well completion and remediation, such as packers and bridge plugs, are actuated by fluid pressure. Wellbore pumps are thus necessary to provide the fluid pressure when utilizing spoolable line to deploy such wellbore tools. Use of wellbore pumps, such as electric pumps run on wireline, can easily increase the cost and complexity of a wellbore procedure.

Therefore, there is a need for a simple and reliable system that can be run on spoolable line and can be used to hydraulically actuate wellbore tools.

SUMMARY OF THE INVENTION

Embodiments of the invention include a wellbore assembly. The wellbore assembly may comprise a conveyance member including at least one of a continuous spooled rod, a wireline, and a slickline. The wellbore assembly may comprise an accumulator system connected to the conveyance member and a setting tool connected to the accumulator system. The accumulator system may be configured to supply a fluid pressure to actuate the setting tool.

Embodiments of the invention include a method of operating a wellbore tool. The method may comprise lowering a wellbore assembly into a wellbore using a conveyance member. The conveyance member may include at least one of a continuous spooled rod, a wireline, and a slickline. The wellbore assembly may include an accumulator system and a setting tool. The method may comprise actuating the accumulator system to provide a fluid pressure to the setting tool. The method may further comprise actuating the setting tool using the fluid pressure and operating the wellbore tool.

Embodiments of the invention include an accumulator system. The accumulator system may comprise a body having a bore disposed through the body, wherein the bore is filled with a fluid. The accumulator system may comprise a valve configured to seal the bore at a first end and a piston configured to seal the bore at a second end. The accumulator system may comprise a releasable member configured to connect the piston to the body, wherein the releasable member is configured to release the piston from the body to permit fluid communication through the second end of the bore.

Embodiments of the invention include a method of operating a wellbore tool. The method may comprise lowering a wellbore assembly into a wellbore using a conveyance member, wherein the wellbore assembly includes an accumulator system and a setting tool. The method may comprise combining a first component with a second component in a chamber of the accumulator system to generate a reaction and generating a rapid pressure increase from the reaction. The method may comprise actuating the setting tool using the rapid pressure increase and operating the wellbore tool.

BRIEF DESCRIPTION OF THE DRAWINGS

So that the manner in which the above recited features of the invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 1:
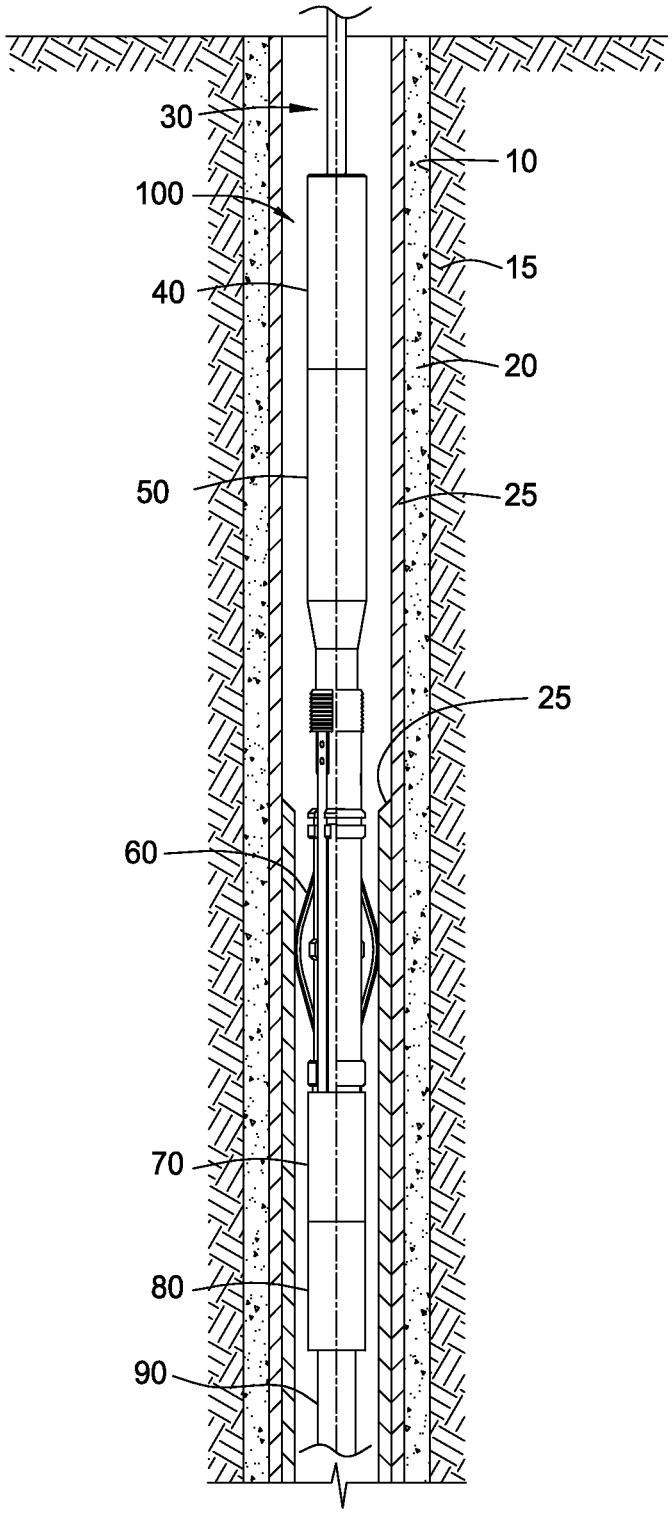
FIG. 1 illustrates a sectional view of an assembly in a wellbore according to one embodiment.

According to one embodiment, FIG. 1 illustrates an assembly 100 in a wellbore 10. As illustrated, the wellbore 10 has one or more strings of casing 25 secured in a formation 15, such as by cured cement 20. The assembly 100 is lowered into the wellbore 10 by a spoolable line, such as a slickline 30. The slickline 30 may be controlled from a surface slickline unit (not shown). In one embodiment, the assembly 100 may be threadedly connected to the slickline 30. In one embodiment, the spoolable line may include a wireline or a continuous spooled rod, such as COROD®.

The assembly 100 may include a weight stem 40, a pump 50, an anchor 60, an accumulator system 70, a setting tool 80, and one or more wellbore tools 90. In one embodiment, a continuous spooled rod, such as COROD®, may be used in the assembly 100 instead of or in addition to the weight stem 40. In one embodiment, the components of the assembly 100 may be threadedly connected to each other. In one embodiment, the wellbore tool 90 may be a packer that is configured to be set using one or more components of the assembly 100.

Figure 2:
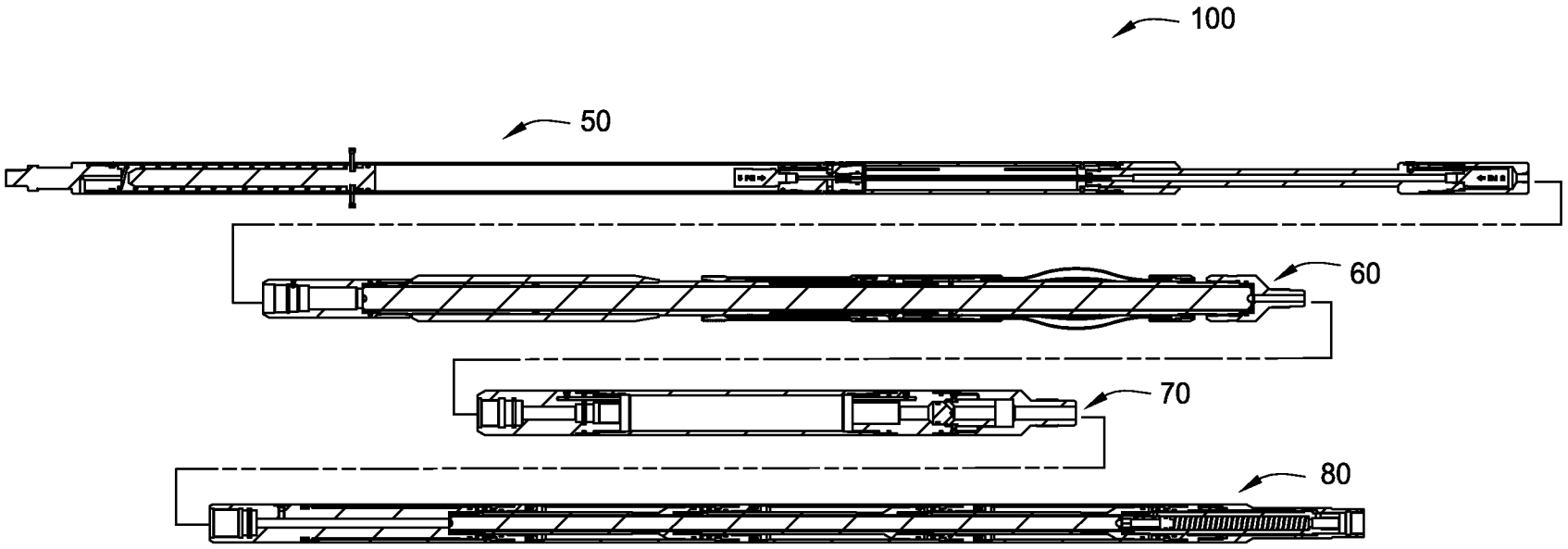
FIG. 2 illustrates a sectional view of the assembly according to one embodiment.

FIG. 2 illustrates a cross-sectional view of the assembly 100 according to one embodiment. As illustrated, the lower end of the pump 50 may be connected to the upper end of the anchor 60. The lower end of the anchor 60 may be connected to the upper end of the accumulator system 70. The lower end of the accumulator system 70 may be connected to the upper end of the setting tool 80. As stated above, one or more wellbore tools 90 may be connected to the lower end of the setting tool 80. The pump 50 may be configured to pump fluid into the accumulator system 70 (through the anchor 60); and the accumulator system 70 may be configured to supply pressurized fluid to the setting tool 80 to actuate the setting tool 80.

A general operation of the assembly 100 according to one embodiment is provided as follows. The assembly 100 may be lowered into the wellbore 10 on the slickline 30 and may be secured in the wellbore 10 using the anchor 60 in a single trip. The pump 50 may then be repeatedly cycled with the assistance of the weight stem 40 to pump fluid into the accumulator system 70. The accumulator system 70 may be configured to contain the fluid provided by the pump 50 until a predetermined amount of fluid pressure is developed in the accumulator system 70. When the predetermined amount of fluid pressure is reached, the accumulator system 70 is configured to release the fluid pressure into the setting tool 80 to actuate the setting tool 80. Upon activation by the fluid pressure, the setting tool 80 is configured to actuate and set the wellbore tool 90 in the wellbore 10.

In one embodiment, the weight stem 40 may include one or more cylindrical members. In one embodiment, the weight stem 40 may be formed from tungsten carbide. In one embodiment, the weight stem 40 may be configured to facilitate actuation of at least the pump 50 and the anchor 60. In one embodiment, a continuous spooled rod, such as COROD®, may be used as the conveyance. The continuous spooled rod may be configured to facilitate actuation of at least the pump 50 and the anchor 60, and the weight stem 40 may be omitted.

As stated above, the assembly 100 may be lowered into the wellbore 10 using the slickline 30 and secured in the wellbore using the anchor 60 in a single trip. The anchor 60 may include any type of tool known by a person of ordinary skill in the art that is operable to secure the assembly 100 in the wellbore 10 using the slickline 30. In one embodiment, the anchor 60 may include an anchor described in U.S. patent application Ser. No. 12/411,338, filed on Mar. 25, 2009, the disclosure of which is herein incorporated by reference in its entirety.

In one embodiment, the anchor 60 is configured to be set in the wellbore 10 by placing the anchor 60 in compression. The anchor 60 may be lowered in the wellbore 10 to a desired location. The assembly 100, including the anchor 60, may then be alternately raised and lowered one or more times using the slickline 30 to position the anchor 60 in a setting position. When the anchor 60 is positioned in the setting position, the weight of the assembly 100 above the anchor 60, including the weight stem 40, may be set down on the anchor 60 to actuate the anchor 60 into engagement with the wellbore 10. The weight may be used to place and retain the anchor 60 in compression, so that the anchor 60 and thus the assembly 100 remains secured in the wellbore 10. In one embodiment, the anchor 60 may include one or more gripping members, such as slips, that are actuated into engagement with the wellbore 10.

As stated above, the pump 50 may be repeatedly cycled with the assistance of the weight stem 40 to pump fluid into the accumulator system 70. The pump 50 may include any type of tool known by a person of ordinary skill in the art that is operable to supply a fluid to the accumulator system 70 in the wellbore 10 using the slickline 30. In one embodiment, the pump 50 may include a slickline pump described in U.S. Pat. No. 7,172,028, filed on Dec. 15, 2003, the disclosure of which is herein incorporated by reference in its entirety.

In one embodiment, the pump 50 may be configured to supply fluid to the accumulator system 70. In one embodiment, after the anchor 60 is set in the wellbore 10 and the assembly 100 is secured, the weight of the assembly 100 above the pump 50, including the weight stem 40, and the slickline 30 may be used to stroke the pump 50. The pump 50 may be stroked to transmit an amount of fluid from the pump 50 to the accumulator system 70. In one embodiment, the pump 50 may be configured to deliver a sufficient amount of fluid in one stroke of the pump to actuate the accumulator system 70 as further described below.

In one embodiment, the pump 50 is located directly below the weight stem 40. A desired amount of force can be provided to stroke the pump 50 by choosing the appropriate combination of the weight stem 40 and tension in the slickline 30. For example, suppose the assembly 100 is anchored and is no longer supported axially by the slickline 30. Further suppose the weight stem 40 weighs 5000 lbs and a 2000 lbs downward force is needed to properly stroke the pump 50. The tension in the slickline 30 is 5000 lbs, based on the weight of the weight stem 40. During the downstroke, a tension of only 3000 lbs would be maintained. As a result, the remaining 2000 lbs of the weight stem 40 that has not been counteracted by tension in the slickline 30, provides a downward force on the pump 50. On the upstroke, the tension in the slickline 30 would be raised to 5000 lbs, which accounts for all the weight of the weight stem 40, allowing the pump 50 to extend completely. The pump 50 transforms the reciprocating motion, consisting of down-strokes and up-strokes, and produces a hydraulic pressure that is relayed to the remainder of the assembly 100 and accumulates in the accumulator system 70.

As stated above, the accumulator system 70 may be configured to contain the fluid provided by the pump 50 until a predetermined amount of fluid pressure is developed in the accumulator system 70. When the predetermined amount of fluid pressure is reached, the accumulator system 70 is configured to release the fluid pressure into the setting tool 80 to actuate the setting tool 80. The accumulator system 70 may include any type of tool known by a person of ordinary skill in the art that is operable to supply a predetermined amount of hydraulic pressure to the setting tool 80.

As stated above, upon activation by the fluid pressure provided by the accumulator system 70, the setting tool 80 is configured to actuate and set the wellbore tool 90 in the wellbore 10. In one embodiment, the setting tool 80 may be uncoupled from the wellbore tool 90 by unthreading a threaded connection and/or releasing a releasable connection, such as a shear screw, a collet, a latch, or other similar releasable component. The setting tool 80 may include any type of tool known by a person of ordinary skill in the art that is operable to actuate the wellbore tool 90 of the assembly 100 in the wellbore 10. In one embodiment, the setting tool 80 may include a setting tool described in U.S. patent application Ser. No. 12/411,338, filed on Mar. 25, 2009, the disclosure of which is herein incorporated by reference in its entirety.

Using the embodiments described above, the assembly 100 may be used to actuate and secure one or more wellbore tools 90 in the wellbore. In one embodiment, the wellbore tool 90 may include a packer assembly described in U.S. patent application Ser. No. 12/411,245, filed on Mar. 25, 2009, and U.S. patent application Ser. No. 11/849,281, filed on Sep. 1, 2007, the disclosures of which are herein incorporated by reference in their entirety.

Figure 3A:
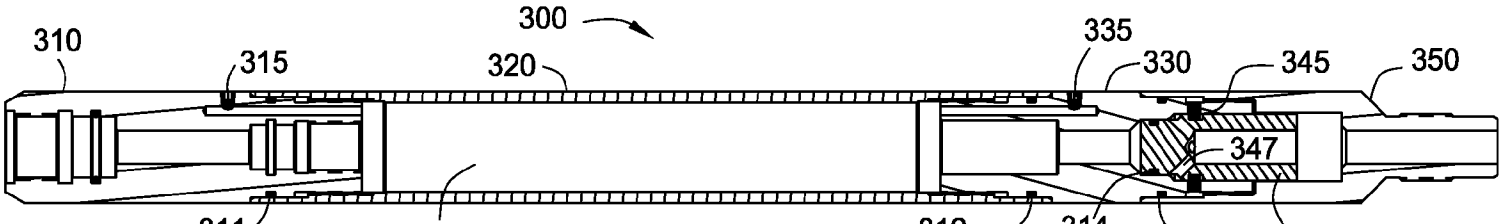
FIGS. 3A and 3B illustrate sectional views of an accumulator system according to one embodiment.
Figure 3B:
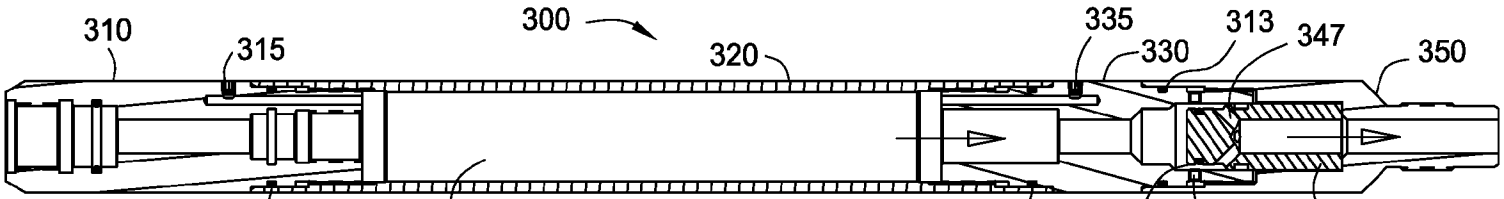

FIGS. 3A and 3B illustrate one embodiment of an accumulator system 300. FIG. 3A illustrates an un-actuated position of the accumulator system 300. FIG. 3B illustrates an actuated position of the accumulator system 300. The accumulator system 300 may include an upper sub 310, a mandrel 320, a piston sub 330, a piston 340, and a lower sub 350. The upper sub 310 may be connected to one end of the anchor 60, such as by a threaded connection. The upper sub 310 may include a cylindrical member having a bore disposed through a body of the member. The upper sub 310 may be connected to one end of the mandrel 320, such as by a threaded connection. The mandrel 320 may include a cylindrical member having a bore disposed through a body of the member. The mandrel 320 may be connected to one end of the piston sub 330, such as by a threaded connection. The piston sub 330 may include a cylindrical member having a bore disposed through a body of the member. The piston sub 330 may be connected to one end of the lower sub 350, such as by a threaded connection. The lower sub 350 may include a cylindrical member having a bore disposed through a body of the member. The lower sub 350 may be connected to one end of the setting tool 80, such as by a threaded connection.

One or more seals 311, 312, and 313, such as o-rings, may be provided to seal the engagements between the upper sub 310, the mandrel 320, the piston sub 330, and the lower sub 350. The upper sub 310 and the piston sub 330 may include one or more ports 315 and 335 configured to supply and return fluid into and out of the accumulator system 300.

The piston 340 may be at least partially disposed within the piston sub 330 and the lower sub 350. The piston 340 may be releasably connected to the piston sub 330 via a releasable member 345, such as a shear screw, a collet, a latch, or other similar releasable component. The piston 340 may include a cylindrical member having one or more ports 347 disposed through the body of the member. The one or more ports 347 may be in fluid communication with the bore of the lower sub 350. A sealed engagement may be provided between the piston 340 and the piston sub 330 using one or more seals 314, such as o-rings. In one embodiment, the piston 340 and/or the releasable member 345 may be configured to be re-settable downhole.

A chamber 325 may be formed within the mandrel 320. In one embodiment, the chamber 325 may be sealed by the sealed engagements between the upper sub 310, the mandrel 320, the piston sub 330, and the piston 340. The chamber 325 may be pre-filled with a fluid via the ports 315 and/or 335. In one embodiment, the fluid may include a compressible fluid, an incompressible fluid, a hydraulic fluid, a gaseous fluid, or combinations thereof. In one embodiment, the fluid may include a gas, such as nitrogen or other similar inert gas. In one embodiment, the chamber 325 may be provided at atmospheric pressure. In one embodiment, the chamber 325 may be filled with a liquid material, a solid material, and combinations thereof.

In one embodiment, the accumulator system 300 may be connected to the assembly 100 in a manner that allows fluid to be communicated from the pump 50 to the chamber 325, through the upper sub 310, while preventing fluid communication out of the accumulator system 300. In one embodiment, a one way valve, such as a check valve, may be disposed in the upper sub 310 to allow fluid to be supplied into the chamber 325 from the pump 50 and prevent fluid communication in the reverse direction.

In operation, one or more fluids may be supplied to the chamber 325 from the pump 50. In one embodiment, the fluid may include a hydraulic fluid. In one embodiment, the fluid may include oil and/or water. The fluid introduced into the chamber 325 from the pump 50 may compress the fluid that is pre-filled in the 325 chamber and/or increase the pressure in the chamber 325. The pressure in the chamber 325 acts on one end of the piston 340. The releasable member 345 may be configured to release the engagement between the piston 340 and the piston sub 330 when the pressure in the chamber 325 reaches a pre-determined amount. When the engagement between the piston 340 and the piston sub 330 is released, the piston 340 may be moved axially relative to the piston sub 330 and lower sub 350 to open fluid communication to the ports 347 around the seal 314. The fluid pressure developed in the chamber 325 may be released and communicated to the setting tool 80 via the ports 347 and the bore of the lower sub 350. The fluid pressure may be used to actuate the setting tool 80, which may actuate and set the wellbore tool 90. In one embodiment, the piston 340 and/or the releasable member 345 may be configured to be re-settable downhole, such that the accumulator system 300 can be actuated multiple times downhole. The accumulator system 300 may be reset downhole to provide one or more bursts of fluid pressure to the setting tool 80.

In one embodiment, the accumulator system 300 may be configured such that a single instance of fluid introduced into the chamber 325 may cause the releasable member 345 to release the engagement of the piston 340. In one embodiment, the chamber 325 may be pre-filled with a fluid pressure such that a single instance of fluid introduced into the chamber 325 may cause the releasable member 345 to release the engagement of the piston 340. The pre-charged fluid pressure may be communicated to the setting tool 80 to actuate the setting tool 80 and thus the wellbore tool 90. In one embodiment, the accumulator system 300 may be re-charged to provide a subsequent burst of fluid pressure to the setting tool 80.

Figure 4:
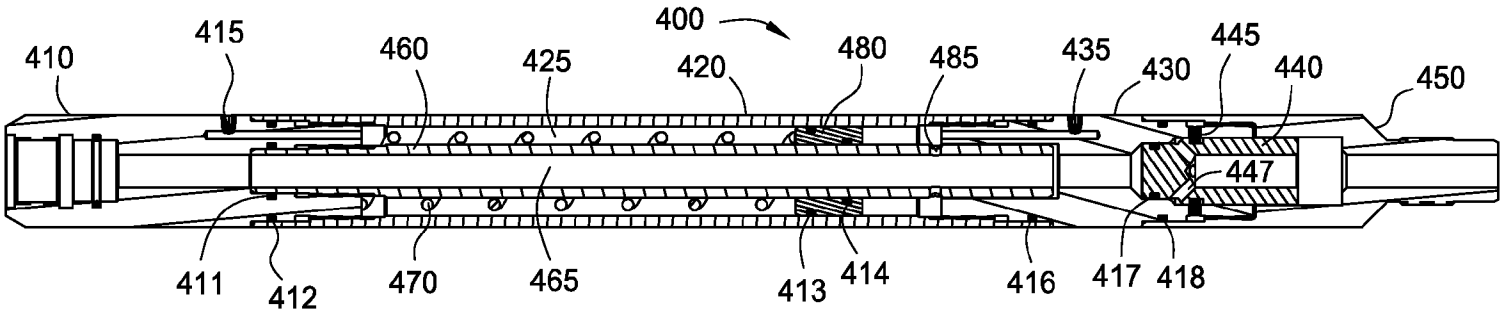
FIG. 4 illustrates a sectional view of the accumulator system according to one embodiment.

FIG. 4 illustrates one embodiment of an accumulator system 400. The accumulator system 400 may be configured for use in a vertical, horizontal, and/or angled section of a wellbore. The accumulator system 400 may include an upper sub 410, an outer mandrel 420, a piston sub 430, a piston 440, a lower sub 450, and an inner mandrel 460. The upper sub 410 may be connected to one end of the anchor 60, such as by a threaded connection. The upper sub 410 may include a cylindrical member having a bore disposed through a body of the member. The upper sub 410 may be connected to one end of the outer mandrel 420 and the inner mandrel 460, such as by a threaded connection. The outer mandrel 420 and the inner mandrel 460 may include a cylindrical member having a bore disposed through a body of the member. The outer mandrel 420 and the inner mandrel 460 may be connected to one end of the piston sub 430, such as by a threaded connection. The piston sub 430 may include a cylindrical member having a bore disposed through a body of the member. The piston sub 430 may be connected to one end of the lower sub 450, such as by a threaded connection. The lower sub 450 may include a cylindrical member having a bore disposed through a body of the member. The lower sub 450 may be connected to one end of the setting tool 80, such as by a threaded connection.

The outer mandrel 420 and the inner mandrel 460 may be connected to the upper sub 410 and the piston sub 430 such that the inner mandrel 460 is disposed within the outer mandrel 420. An inner chamber 465 may be formed through the bore of the inner mandrel 460, which is in fluid communication with the bores of the upper sub 410 and the piston sub 430. An outer chamber 425 may be formed through the bore of the outer mandrel 420. In particular, the outer chamber 425 may be formed between the inner surface of the outer mandrel 420, the outer surface of the inner mandrel 460, the bottom of the upper sub 410, and the top of a piston member 480. The piston member 480 may include a cylindrical member having a bore disposed through the body of the member. The piston member 480 may be sealingly disposed between the outer mandrel 420 and the inner mandrel 460 via one or more seals 413 and 414, such as o-rings. The piston member 480 may be movably disposed between the outer mandrel 420 and the inner mandrel 460. The piston member 480 may be biased on one side by a biasing member 470, such as a spring, that is disposed in the outer chamber 425. The biasing member 470 may bias the piston member 480 away from the bottom end of the upper sub 410. The opposite side of the piston member 480 may be acted on by fluid pressure developed in the inner chamber 465 via one or more ports 485 disposed through the body of the inner mandrel 460.

One or more seals 411, 412, 416, and 418, such as o-rings, may be provided to seal the engagements between the upper sub 410, the outer mandrel 420, the inner mandrel 460, the piston sub 430, and the lower sub 450. The upper sub 410 and the piston sub 430 may include one or more ports 415 and 435 configured to supply and return fluid into and out of the outer chamber 425 and/or inner chamber 465, respectively.

The piston 440 may be at least partially disposed within the piston sub 430 and the lower sub 450. The piston 440 may be releasably connected to the piston sub 430 via a releasable member 445, such as a shear screw, a collet, a latch, or other similar releasable component. The piston 440 may include a cylindrical member having one or more ports 447 disposed through the body of the member. The one or more ports 447 may be in fluid communication with the bore of the lower sub 450. A sealed engagement may be provided between the piston 440 and the piston sub 430 using one or more seals 417, such as o-rings. In one embodiment, the piston 440 and/or the releasable member 445 may be configured to be re-settable downhole.

As stated above, the outer chamber 425 may be formed within the outer mandrel 420. In one embodiment, the outer chamber 425 may be sealed by the sealed engagements between the upper sub 410, the outer mandrel 420, the inner mandrel 460, and the piston member 480. The outer chamber 425 may be pre-filled with a fluid via the port 415. In one embodiment, the fluid may include a compressible fluid, an incompressible fluid, a hydraulic fluid, a gaseous fluid, or combinations thereof. In one embodiment, the fluid may include a gas, such as nitrogen or other similar inert gas. In one embodiment, the outer chamber 425 may be provided at atmospheric pressure. In one embodiment, the outer chamber 425 may be filled with a liquid material, a solid material, and/or other types of comparable materials.

In one embodiment, the accumulator system 400 may be connected to the assembly 100 in a manner that allows fluid to be communicated from the pump 50 to the inner chamber 465, through the upper sub 410, while preventing fluid communication out of the accumulator system 400. In one embodiment, a one way valve, such as a check valve, may be disposed in the upper sub 410 to allow fluid to be supplied into the chamber 465 from the pump 50 and prevent fluid communication in the reverse direction.

In operation, one or more fluids may be supplied to the inner chamber 465 from the pump 50. In one embodiment, the fluid may include a hydraulic fluid. In one embodiment, the fluid may include oil and/or water. The fluid introduced into the inner chamber 465 from the pump 50 may act on the piston member 480 (via the ports 485) against the bias of the biasing member 470, thereby collapsing the volume of the outer chamber 425 and compressing the fluid that is pre-filled in the outer chamber 425 if provided. The fluid pressure in the outer chamber 425 and the inner chamber 465 may be increased accordingly as fluid is further introduced into the inner chamber 465 from the pump 50. The fluid pressure in the inner chamber 465 also acts on one end of the piston 440. The releasable member 445 may be configured to release the engagement between the piston 440 and the piston sub 430 when the pressure in the chamber 465 reaches a pre-determined amount. When the engagement between the piston 440 and the piston sub 430 is released, the piston 440 may be moved axially relative to the piston sub 430 and lower sub 450 to open fluid communication to the ports 447 around the seal 417. The fluid pressure developed in the inner chamber 465 may be released and communicated to the setting tool 80 via the ports 447 and the bore of the lower sub 450. The fluid pressure developed in the outer chamber 425 and the biasing member 470 may also move the piston member 480 against the fluid pressure in the inner chamber 465 and force the fluid pressure into the setting tool 80. The fluid pressure may be used to actuate the setting tool 80, which may actuate and set the wellbore tool 90. In one embodiment, the piston 440 and/or the releasable member 445 may be configured to be re-settable downhole, such that the accumulator system 400 can be actuated multiple times downhole. The accumulator system 400 may be reset downhole to provide one or more bursts of fluid pressure to the setting tool 80.

In one embodiment, the accumulator system 400 may be configured such that a single instance of fluid introduced into the inner chamber 465 may cause the releasable member 445 to release the engagement of the piston 440. In one embodiment, the inner chamber 465 may be pre-filled with a fluid pressure such that a single instance of fluid introduced into the inner chamber 465 may cause the releasable member 445 to release the engagement of the piston 440. The pre-charged fluid pressure may be communicated to the setting tool 80 to actuate the setting tool 80 and thus the wellbore tool 90. In one embodiment, the accumulator system 400 may be re-charged to provide a subsequent burst of fluid pressure to the setting tool 80.

Figure 8A:
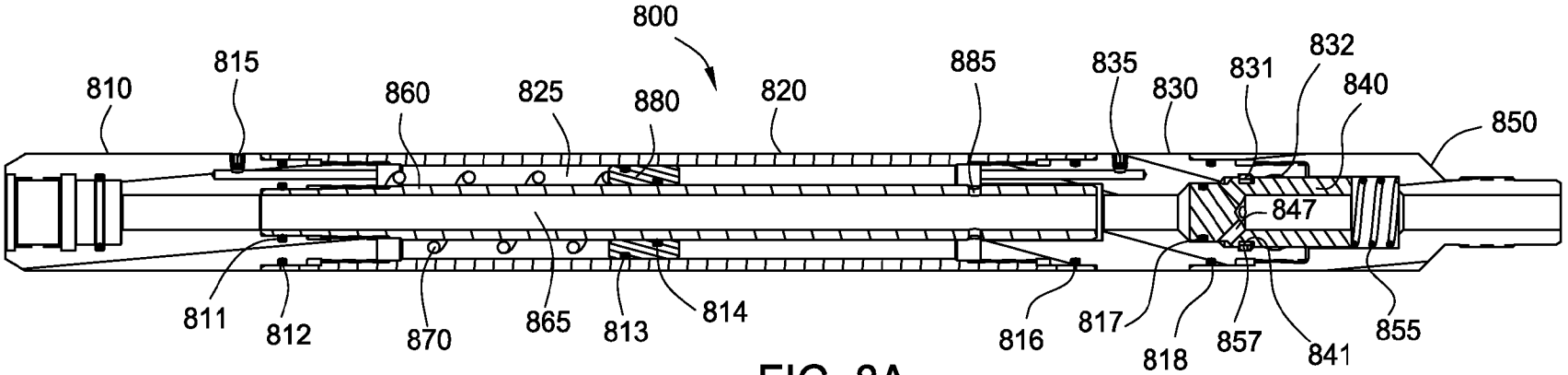
FIGS. 8A and 8B illustrate sectional views of the accumulator system according to one embodiment.
Figure 8B:
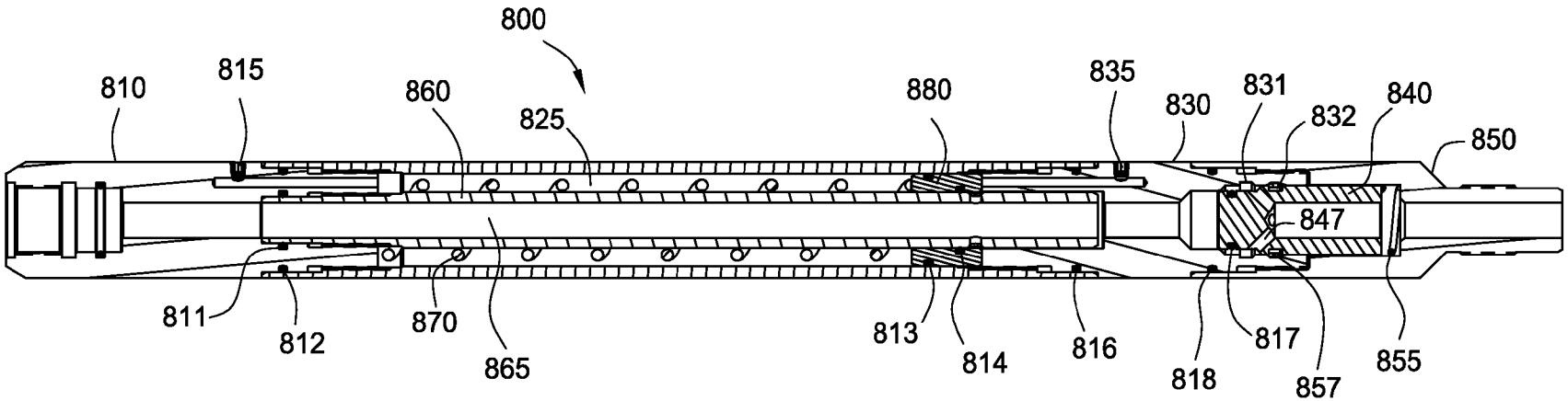

FIGS. 8A and 8B illustrate one embodiment of an accumulator system 800. The accumulator system 800 is substantially similar in operation and embodiment as the accumulator system 400 described above. Similar components between the accumulator systems 400 and 800 are labeled with an "800" series reference numeral and a description of these similar components will not be repeated for brevity.

The accumulator system 800 further includes a biasing member 855, such as a spring and a locking member 857, such as a c-ring. The biasing member 855 is located in the bore of the lower sub 850 and is configured to bias the piston 840 into a closed position. As illustrated in FIG. 8A, when the piston 840 is in the closed position, fluid communication through the bore of the accumulator system 800 is closed. The locking member 857 is located in a groove 841 disposed in the outer surface of the piston 840. The locking member 857 is movable between a first groove 831 and an optional second groove 832 disposed in the inner surface of the piston sub 830 upon actuation of the accumulator system 800 to temporarily secure the piston 840 in the closed position and an open position, respectively. As illustrated in FIG. 8B, when the piston 840 is in the open position, fluid communication through the bore of the accumulator system 800 is open. The accumulator system 800 may be actuated one or more times using the biasing member 855 and locking member 857 configuration.

In operation, one or more fluids may be supplied to the inner chamber 865 from the pump 50. The fluid introduced into the inner chamber 865 acts on an end of the piston 840 as the inner chamber 865 is pressurized. When the pressure in the inner chamber 865 reaches a pre-determined amount, such as a pressure sufficient to generate a force on the end of the piston 840 greater than the biasing force of the biasing member 855, the piston 840 may be moved axially relative to the piston sub 830 and lower sub 850 to open fluid communication to the ports 847 around the seal 817. The locking member 857 may also be directed from the first groove 831 to the optional second groove 832 to temporarily secure the piston 840 in the open position. The fluid pressure developed in the inner chamber 865 may be released and communicated to the setting tool 80 via the ports 847 and the bore of the lower sub 850. The fluid pressure developed in the outer chamber 825 and the biasing member 870 may also move the piston member 880 against the fluid pressure in the inner chamber 865 and force the fluid pressure into the setting tool 80. The locking member 857 may prevent "chattering" of the piston 840 as the fluid pressure is released from the inner chamber 865 through the ports 847. The fluid pressure may be used to actuate the setting tool 80, which may actuate and set the wellbore tool 90.

When the pressure is released from the inner chamber 865, the biasing member 855 may be configured to bias the piston 840 (and the locking member 857) back into the closed position. The locking member 857 may be directed from the second groove 832 to the first groove 831 to temporarily secure the piston 840 in the closed position. In this manner, the accumulator system 800 may be re-settable downhole, such that the accumulator system 800 can be actuated multiple times downhole. The accumulator system 800 may be reset downhole to provide one or more bursts of fluid pressure to the setting tool 80.

Figure 9:
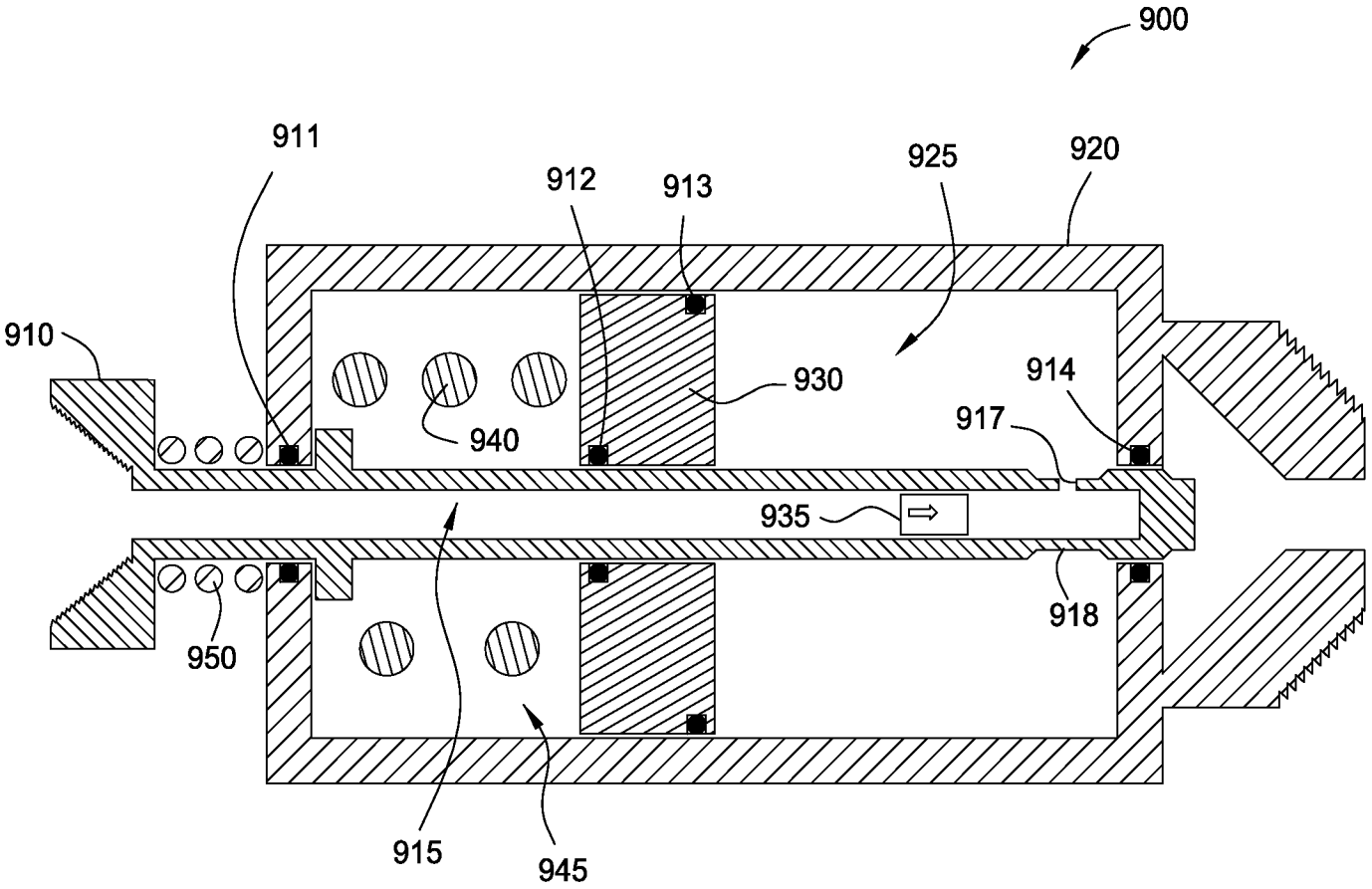
FIG. 9 illustrates a sectional view of the accumulator system according to one embodiment.

FIG. 9 illustrates one embodiment of an accumulator system 900. The accumulator system 900 may include an inner mandrel 910, an outer mandrel 920, a piston 930, a first biasing member 940, and an optional second biasing member 950. In one embodiment, alternatively or in addition to the second biasing member 950, a locking assembly such as a détente, a collet, a c-ring, a latch, or other similar locking component may be used to secure the accumulator system 900 from pre-mature actuation and facilitate operation with the assembly 100. The upper end of the inner mandrel 910 may be configured to connect the accumulator system 900 to the assembly 100, such as by a threaded connection to the pump 50 and/or the anchor 60, and the lower end of the outer mandrel 920 may be configured to connect the accumulator system 900 to the assembly 100, such as by a threaded connection to the anchor 60 and/or the setting tool 80.

The inner mandrel 910 may be movably coupled to the outer mandrel 920 and may be partially disposed in the bore of the outer mandrel 920 to thereby form a first chamber 925 and a second chamber 945. The piston 930 may also be movably coupled to the inner and outer mandrels and may be disposed in the bore of the outer mandrel 920 to sealingly separate the first and second chambers. The first biasing member 940, such as a spring, may optionally be disposed in the second chamber 945 and configured to bias the piston 930 against fluid provided in the first chamber 925. In one embodiment, the chamber 945 may be pre-filled with a pre-determined amount of fluid pressure. The optional second biasing member 950, such as a spring, may optionally be positioned between an end of the outer mandrel 920 and a shoulder disposed adjacent the upper end of the inner mandrel 910 to bias the inner mandrel 920 into a closed position. When in the closed position, fluid communication between (1) the bore 915 of the inner mandrel 910 and/or first chamber 925 and (2) the bore through the lower end of the outer mandrel 920 is closed. Another shoulder may be provided on the inner mandrel 910 to prevent removal of the inner mandrel 910 from the bore of the outer mandrel 920. A valve 935, such as a check valve or one-way valve, may be provided in the bore of the inner mandrel 910 to permit fluid communication to the first chamber 925 via a port 917 disposed in the body of the inner mandrel 910. One or more seals 911, 912, 913, and 914, such as o-rings, may be provided to seal the engagements between the inner mandrel, 910, the outer mandrel 920, and the piston 930.

In operation, the first chamber 925 may be pressurized using the pump 50 and/or may be pre-filled with a pressure sufficient to actuate the setting tool 80. A force may be provided to the upper end of the inner mandrel 910 to move the inner mandrel 910 to an open position, overcoming the bias of the second biasing member 950. The force may be provided from the spoolable line 30 and/or the weight stem 40. When in the open position, fluid communication between (1) the bore 915 of the inner mandrel 910 and/or first chamber 925 and (2) the bore through the lower end of the outer mandrel 920 is open. The inner mandrel 910 may be moved axially relative to the outer mandrel 920 to open fluid communication through a recess 918 disposed in the inner mandrel 910 around the seal 914. The pressure developed in the first chamber 925 may be released and communicated to the setting tool 80 through the bore at the lower end of the outer mandrel 920. The pressure developed in the second chamber 945 and/or the first biasing member 940 may also move the piston 930 against the pressure in the first chamber 925 and force the pressure into the setting tool 80. The fluid pressure may be used to actuate the setting tool 80, which may actuate and set the wellbore tool 90.

When the pressure is released from the first chamber 925, the force may be relieved from the upper end of the inner mandrel 910 and the second biasing member 950 may be configured to bias the inner mandrel 910 back into the closed position. Alternatively, or additionally, a force may be provided to the upper end of the inner mandrel 910 to direct the inner mandrel back into the closed position. The inner chamber 925 may then be pressurized again using the pump 50. In one embodiment, the inner chamber 925 may be re-pressurized to a greater, lesser, or substantially equal pressure than the pressure that was previously released. In this manner, the accumulator system 900 may be re-settable downhole, such that the accumulator system 900 can be actuated multiple times downhole. The accumulator system 900 may be reset downhole to provide one or more bursts of fluid pressure to the setting tool 80.

Figure 10:
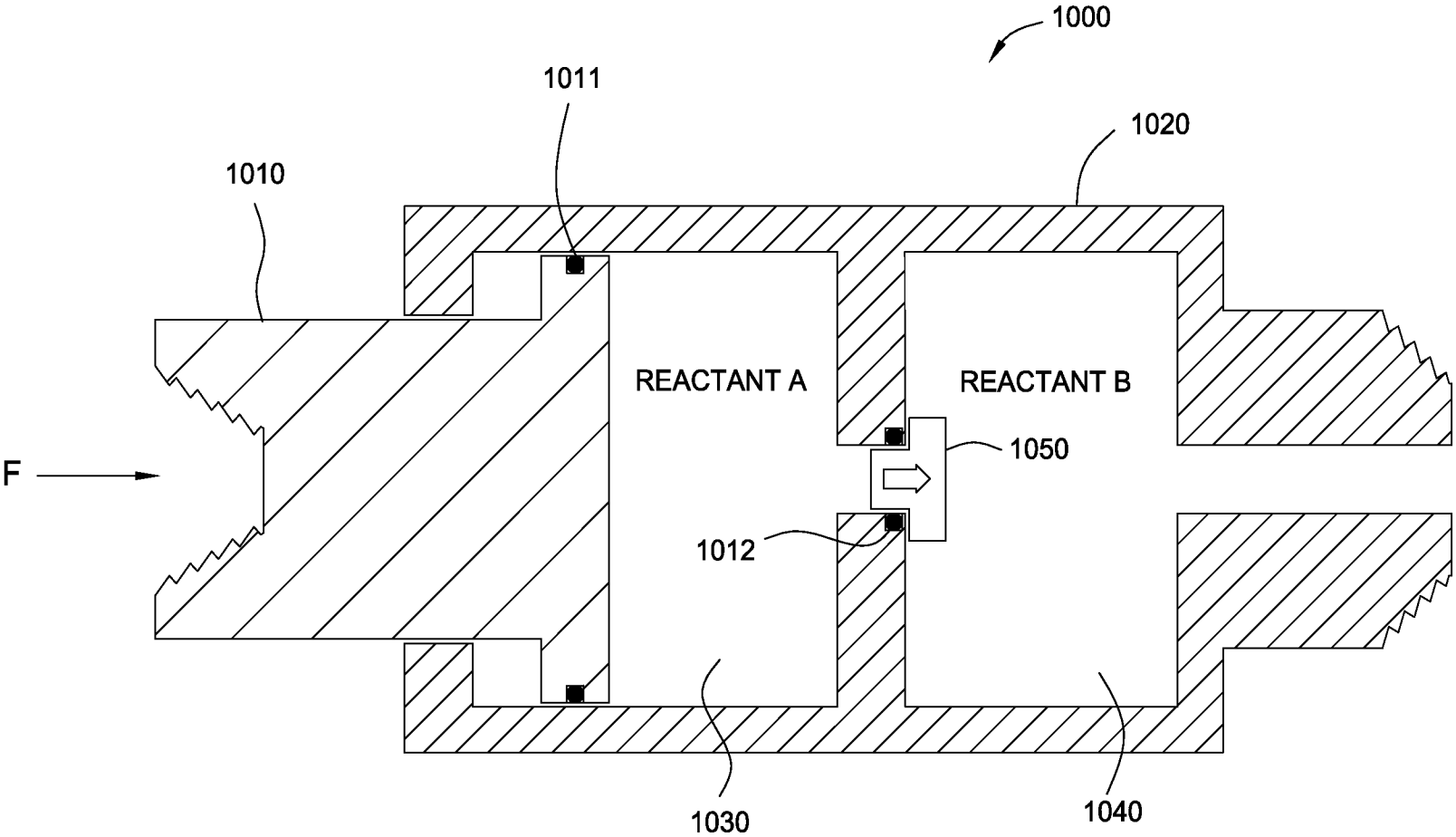
FIG. 10 illustrates a sectional view of the accumulator system according to one embodiment.

FIG. 10 illustrates one embodiment of an accumulator system 1000. The accumulator system 1000 may include a piston member 1010, an outer mandrel 1020, and a valve 1050. The upper end of the piston member 1010 may be configured to connect the accumulator system 1000 to the assembly 100, such as by a threaded connection to the spoolable line 30 and/or the anchor 60, and the lower end of the outer mandrel 1020 may be configured to connect the accumulator system 1000 to the assembly 100, such as by a threaded connection to the anchor 60 and/or the setting tool 80.

The piston member 1010 may be movably coupled to the outer mandrel 1020 and may be partially disposed in a first chamber 1030 formed in the bore of the outer mandrel 1020. A shoulder may be provided at the end of the piston member 1010 to prevent removal of the piston member 1010 from the bore of the outer mandrel 1020. A second chamber 1040 may also be formed in the bore of the outer mandrel 1020, and the valve 1050 may be connected to the outer mandrel 1020 to control fluid communication between the first and second chambers. In one embodiment, the valve 1050 is a one way valve, such as a check valve or a flapper valve configured to permit fluid communication from the first chamber 1030 to the second chamber 1040. One or more seals 1011 and 1012, such as o-rings, may be provided to seal the engagements between the piston member 1010, the outer mandrel 1020, and the valve 1050.

In one embodiment, the first chamber 1030 may be pre-filled with one or more first components (Reactant A) and the second chamber 1040 may be pre-filled with one or more second components (Reactant B). A force may be provided to the upper end of the piston member 1010 to move the piston member 1010 and collapse and/or pressurize the first chamber 1030. The force may be provided from the spoolable line 30 and/or the weight stem 40. The first component in the first chamber 1030 may then be supplied into the second chamber via the valve 1050 and mixed with the second component.

The first and second components may be combined to cause a reaction, such as an explosive or chemical reaction. The reaction caused may generate a rapid pressure increase in the second chamber 1040 sufficient to actuate the setting tool 80. In one embodiment, the reaction may be induced by the pressure increase in the second chamber 1040. In one embodiment, the reaction may be induced by a combination of the first and second component mixture and the pressure increase in the second chamber 1040. In one embodiment, the reaction may form one or more products that cause the rapid pressure increase in the second chamber 1040. The pressure developed in the second chamber 1040 may then be communicated to the setting 80 to actuate the setting tool 80 and thus the wellbore tool 90. In one embodiment, the reaction may include the evaporation of one or more components in the second chamber 1040. The first and second components may be provided in and/or converted to a liquid component, a solid component, a gas component, and combinations thereof.

In one embodiment, the reaction may include the rapid expansion of one or more components, such as a gas or gas mixture, in the second chamber 1040. In one embodiment, the reaction may include the combustion of one or more components in the second chamber 1040. In one embodiment, the reaction may include the ignition of one or more components in the second chamber 1040 using a heat source, an ignition source, and/or when subjected to a pressurized environment. The one or more first and second components may include one or more combinations of the following items provided in the list of components recited near the end of the detailed description.

In one embodiment, one or more components may be combined in the second chamber 1040 to form a fuel and/or an oxidant. In one embodiment, the first chamber 1030 and the second chamber 1040 may be pre-filled with a fuel and/or an oxidant or may be in fluid communication with a fuel source and/or an oxidant source. In one embodiment, one or more components may be combined in the second chamber 1040 to form a compound including a fuel, such as hydrogen, and/or an oxidant, such as oxygen. In one embodiment, an alloy of aluminum and gallium may be combined with water in the second chamber 1040 to form hydrogen. The combined components may then be ignited, such as with an ignition source, to generate a rapid pressure increase. The pressure in the second chamber 1040 may then be communicated to the setting tool 80. In one embodiment, only a portion of the first component provided in the first chamber 1030 is supplied to the second chamber 1040, such that a subsequent portion of the first component may be supplied at a separate time to provide one or more bursts of pressure to the setting tool 80. In one embodiment, the accumulator system 1000 may be configured to provide a subsequent pressure that is greater or lesser than the pressure that was previously supplied to the setting tool 80. In one embodiment, the accumulator system 1000 may be configured to provide a subsequent pressure that is substantially equal to the pressure that was previously supplied to the setting tool 80.

Figure 11:
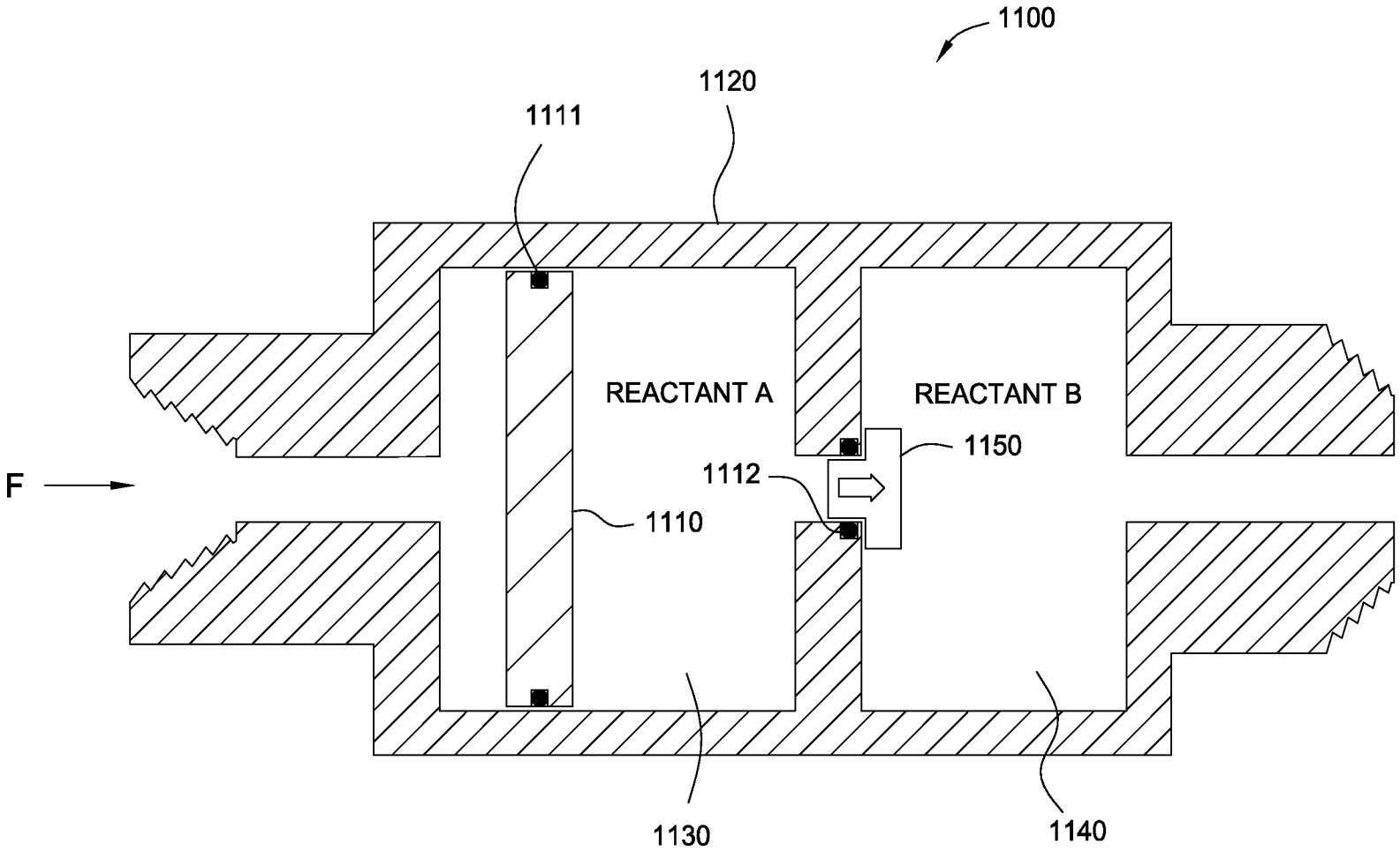
FIG. 11 illustrates a sectional view of the accumulator system according to one embodiment.

FIG. 11 illustrates one embodiment of an accumulator system 1100. The accumulator system 1100 is substantially similar in operation and embodiment as the accumulator system 1000 described above. Similar components between the accumulator systems 1000 and 1100 are labeled with an "1100" series reference numeral and a description of these similar components will not be repeated for brevity.

As shown, the upper and lower ends of the outer mandrel 1120 are configured to connect the accumulator system 1100 to the assembly and the piston member 1110 is movably disposed in the bore of the outer mandrel 1120. Fluid pressure may be supplied through the upper end of the outer mandrel 1120, such as from the pump 50, to act on the piston member 1110 and urge the first component from the first chamber 1130 into to the second chamber 1140 via the valve 1150. The mixture of the first and second components may generate a pressure sufficient to actuate the setting tool 80.

Figure 12:
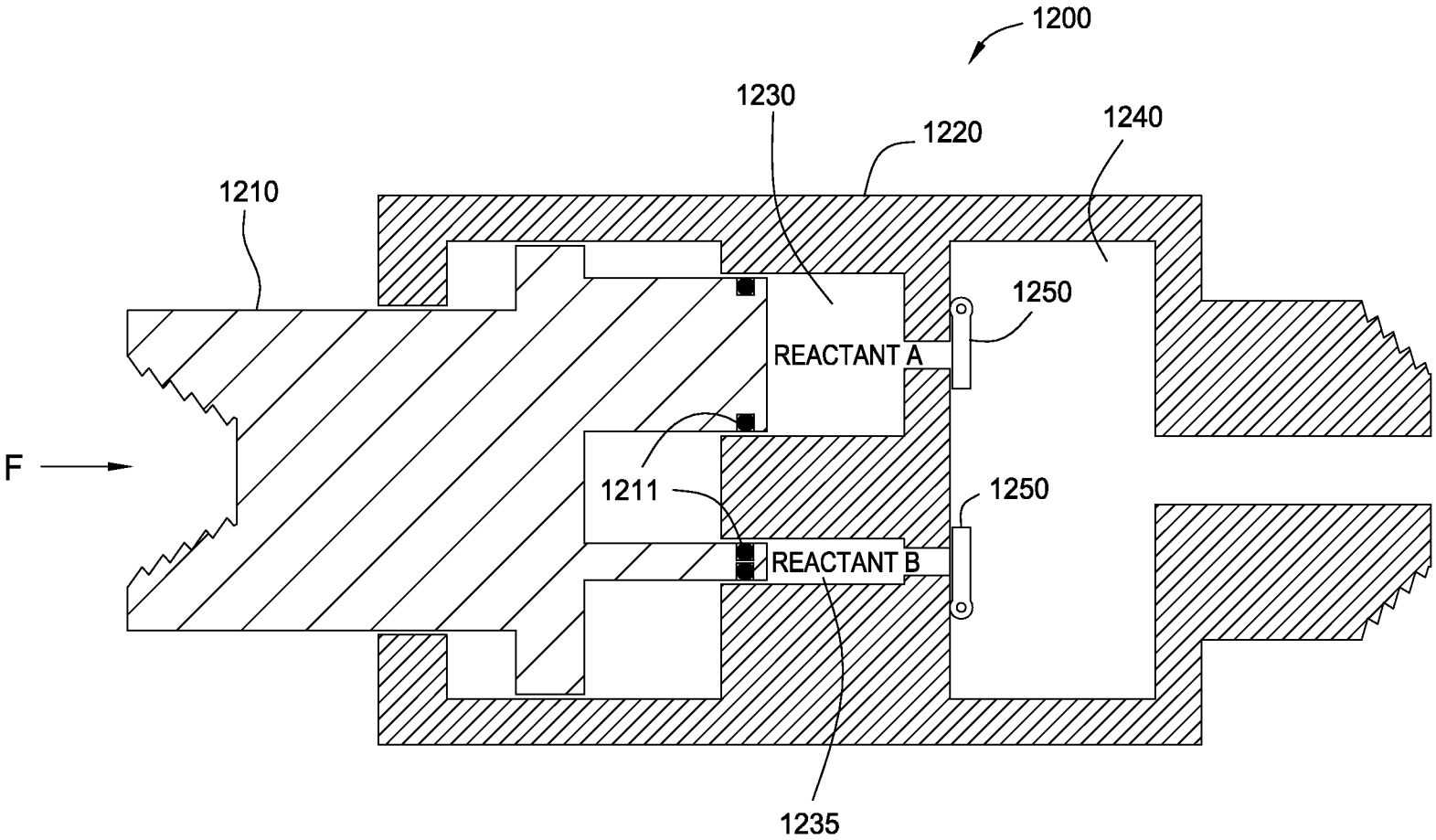
FIG. 12 illustrates a sectional view of the accumulator system according to one embodiment.

FIG. 12 illustrates one embodiment of an accumulator system 1200. The accumulator system 1200 is substantially similar in operation and embodiment as the accumulator system 1000 described above. Similar components between the accumulator systems 1000 and 1200 are labeled with a "1200" series reference numeral and a description of these similar components will not be repeated for brevity.

As shown, a third chamber 1235 is provided in the bore of the outer mandrel 1220 and the piston member 1210 forms a piston end that sealingly engages the first chamber 1230 and the third chamber 1235. The first chamber 1230 may be pre-filled with the one or more first components (Reactant A) and the third chamber may be pre-filled with the one or more second components (Reactant B). A force may be provided to the upper end of the piston member 1210 to move the piston member 1210 and collapse and/or pressurize the first and third chambers. The force may be provided from the spoolable line 30 and/or the weight stem 40. The first and second components may then be supplied into the second chamber 1240 via one or more valves 1250 and mixed together to generate a pressure sufficient to actuate the setting tool 80. In one embodiment, the piston member 1210 may be hydraulically actuated.

Figure 13:
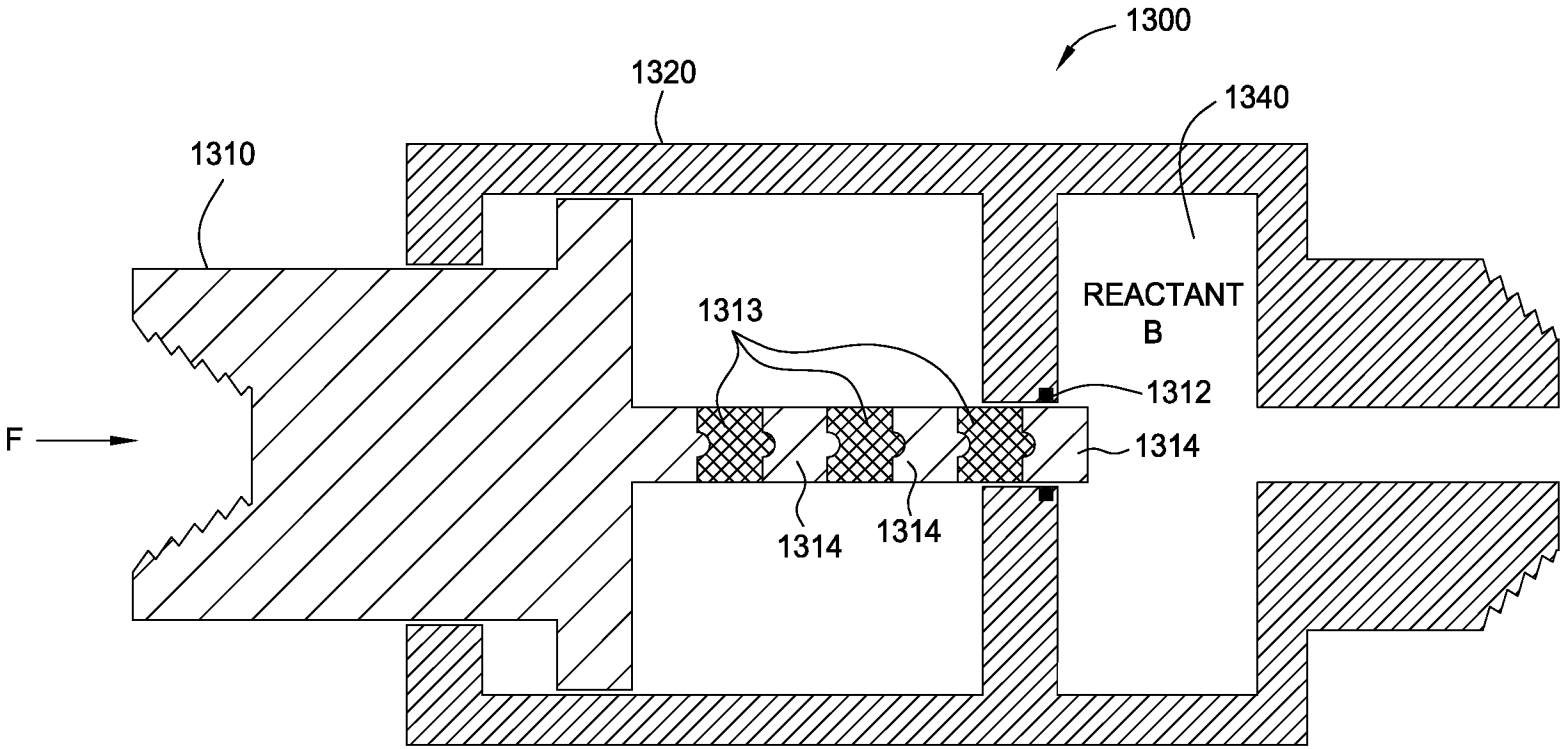
FIG. 13 illustrates a sectional view of the accumulator system according to one embodiment.

FIG. 13 illustrates one embodiment of an accumulator system 1300. The accumulator system 1300 is substantially similar in operation and embodiment as the accumulator system 1000 described above. Similar components between the accumulator systems 1000 and 1300 are labeled with a "1300" series reference numeral and a description of these similar components will not be repeated for brevity.

As shown, the piston member 1310 includes an end having one or more first components (Reactant A) 1313 separated by one or more non-reactive components 1314. The second chamber 1340 may be pre-filled with one or more second components (Reactant B) configured to react with the first components 1313. A force may be provided to the upper end of the piston member 1310 to move the end of the piston member 1310 into the second chamber 1340. The force may be provided from the spoolable line 30 and/or the weight stem 40. The one or more of the first components may be exposed to the second component and mixed together to generate a pressure sufficient to actuate the setting tool 80.

In one embodiment, each of the one or more first components 1313 may include a different component, amount, and/or concentration than the other components. The piston member 1310 may be configured to provide multiple stages of a reaction between the first components 1313 and the second component. The non-reactive components 1314 may be provided to separate the stages of reaction. In one embodiment, the accumulator system 1300 may include an indication mechanism, such as a c-ring or collet member, configured to monitor the relative movement, location, and position of the piston member 1310 to the outer mandrel 1320. The indication mechanism may assist in determining the component and/or stage that is being introduced into the second chamber 1340. In one embodiment, the piston member 1310 may be hydraulically actuated.

Figure 14:
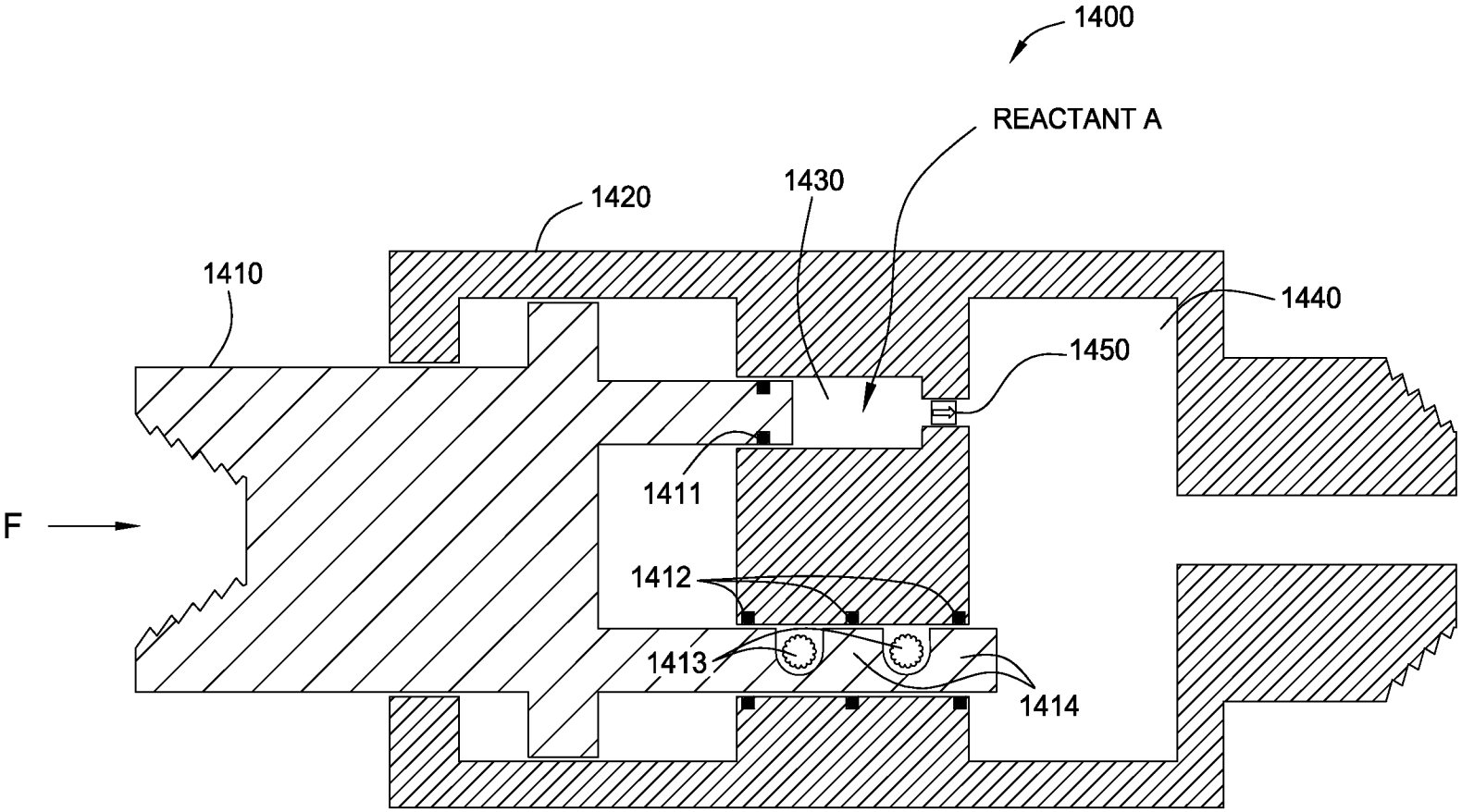
FIG. 14 illustrates a sectional view of the accumulator system according to one embodiment.

FIG. 14 illustrates one embodiment of an accumulator system 1400. The accumulator system 1400 is substantially similar in operation and embodiment as the accumulator system 1000 described above. Similar components between the accumulator systems 1000 and 1400 are labeled with a "1400" series reference numeral and a description of these similar components will not be repeated for brevity.

As shown, the piston member 1410 includes an end having one or more third components 1413 separated by one or more non-reactive portion 1414. The first chamber 1430 may be pre-filled with one or more first components (Reactant A), and the second chamber 1440 may optionally be pre-filled with one or more second components (Reactant B). A force may be provided to the upper end of the piston member 1410 to urge the first component in the first chamber 1430 into the second chamber 1440 via the valve 1450 and move the end of the piston member 1410 having the one or more third components 1413 into the second chamber 1440. The force may be provided from the spoolable line 30 and/or the weight stem 40. The first, second, and/or third components may be combined to cause the reaction that generates a pressure sufficient to actuate the setting tool 80.

In one embodiment, each of the one or more third components 1413 may include a different component, amount, and/or concentration than the other components. The piston member 1410 may be configured to provide multiple stages of a reaction between the components in the second chamber 1440. The non-reactive portions 1414 may be provided to separate the stages of reaction. In one embodiment, the accumulator system 1400 may include an indication mechanism, such as a c-ring or collet member, configured to monitor the relative movement, location, and position of the piston member 1410 to the outer mandrel 1420. The indication mechanism may assist in determining the component and/or stage that is being introduced into the second chamber 1440. In one embodiment, the piston member 1410 may be hydraulically actuated.

Figure 15:
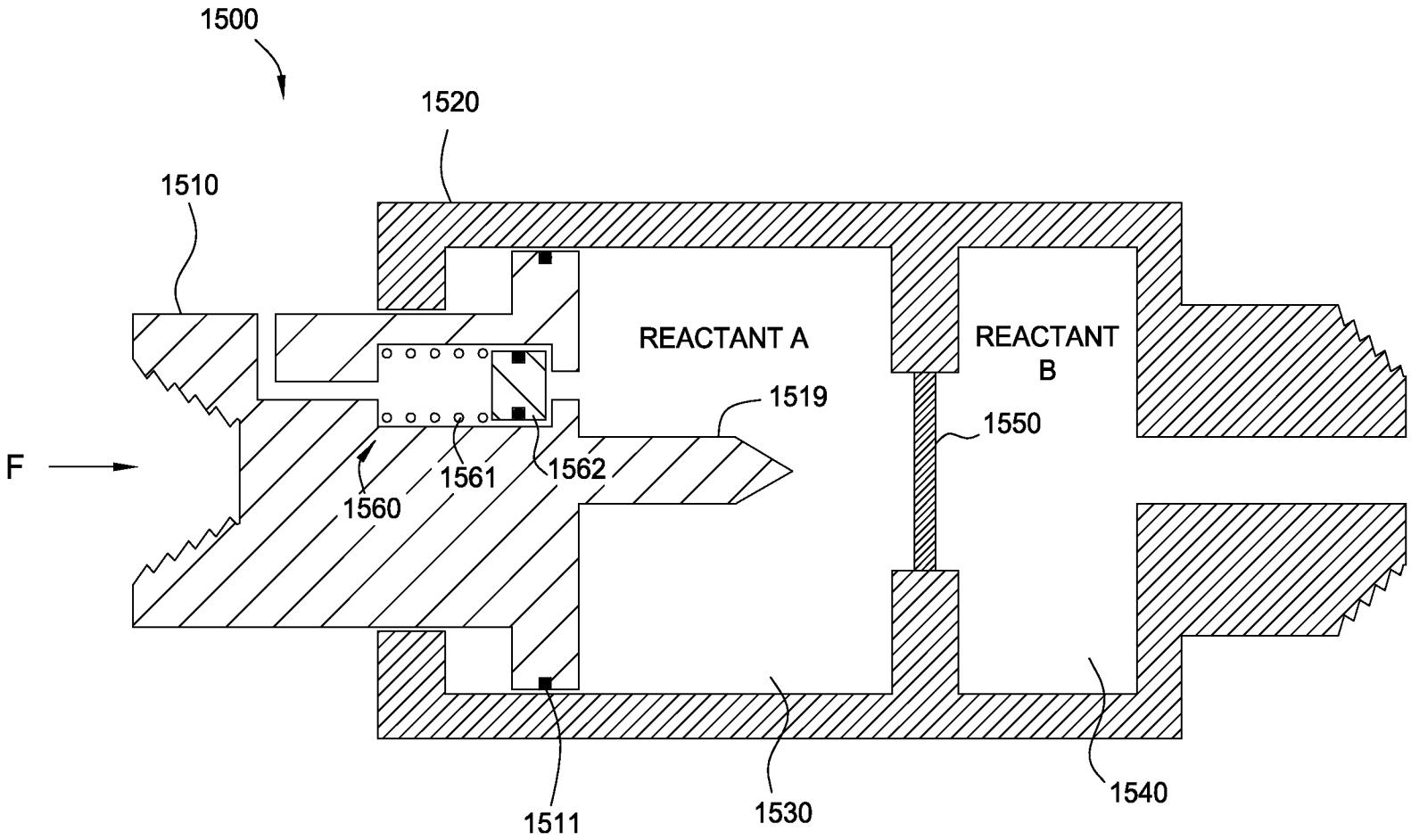
FIG. 15 illustrates a sectional view of the accumulator system according to one embodiment.

FIG. 15 illustrates one embodiment of an accumulator system 1500. The accumulator system 1500 is substantially similar in operation and embodiment as the accumulator system 1000 described above. Similar components between the accumulator systems 1000 and 1500 are labeled with a "1500" series reference numeral and a description of these similar components will not be repeated for brevity.

As shown, the piston member 1510 includes an end 1519 configured to open a valve member 1550. The valve member 1550 is configured to temporarily close fluid communication between the first chamber 1530 and the second chamber 1540. The valve member 1550 may include a breakable membrane, such as rupture disk that can be fractured using the end 1519 of the piston member 1510 to open fluid communication therethrough. The first and second chambers may be pre-filled with one or more components (Reactants A and B) configured to react with each other to generate a rapid pressure increase. A force may be provided to the upper end of the piston member 1510 to move the end 1519 of the piston member 1510 into the valve member 1550 to open fluid communication therethrough. The force may be provided from the spoolable line 30 and/or the weight stem 40. The first component may be combined with the second component to generate a pressure sufficient to actuate the setting tool 80.

In one embodiment, the accumulator system 1500 may include a compensation system 1560 having a biasing member 1561, such as a spring, and a piston 1562. The compensation system 1560 may be provided to compensate for the volume and/or thermal increase of the component in the first chamber 1530 upon actuation of the piston member 1510. In one embodiment, the piston member 1510 may be hydraulically actuated.

In one embodiment, the assembly 100 may include a reservoir configured to store a fluid and/or other component that is supplied to the accumulator systems 300 and 400 to actuation the accumulator systems. The reservoir may be lowered into the wellbore with the assembly 100. The reservoir may be operable to supply the fluid and/or other component to the accumulator systems. In one embodiment, the assembly 100 may be configured to supply a fluid and/or other component located in the wellbore to the accumulator systems 300 and 400. The assembly 100 may be operable to direct the in-situ wellbore fluids to the accumulator systems for actuation of the accumulator systems. In one embodiment, the assembly 100 may utilize both a reservoir and in-situ wellbore fluids to facilitate actuation of the accumulator systems.

In one embodiment, the accumulator systems 300 and 400 may be re-set downhole to actuate the setting tool 80 one or more times. The chambers 325 and 465 may be pressurized multiple times using the pump and/or pre-charged with pressure and then re-pressurized downhole to actuate the setting tool 80 more than once. For example, in the event that the setting tool 80 fails to properly set the wellbore tool 90, the accumulator systems may be re-pressurized to provide a subsequent amount of pressure to actuate the setting tool 80 again and properly set the wellbore tool 90.

In one embodiment, the accumulator systems 300 and 400 may be configured such that the chambers 325 and 465 are pre-filled with one or more first components. One or more second components may be introduced into the chambers 325 and 465 and mixed with the first component(s) to cause a reaction, such as an explosive or chemical reaction. The reaction caused may generate a rapid pressure increase in the chambers sufficient to cause the releasable members 345 and 445 to release the engagement of the pistons 340 and 440 as stated above. In one embodiment, the reaction may be induced by the pressure increase in the chambers provided by the pump 50. In one embodiment, the reaction may be induced by a combination of the first and second component mixture and the pressure increase in the chambers provided by the pump 50. In one embodiment, the reaction may form one or more products that cause the rapid pressure increase in the chambers. The pressure developed in the chambers may then be communicated to the setting 80 to actuate the setting tool 80 and thus the wellbore tool 90. In one embodiment, the reaction may include the evaporation of one or more components in the chambers. The first and second components may be provided in and/or converted to a liquid component, a solid component, a gas component, and combinations thereof.

In one embodiment, the reaction may include the rapid expansion of one or more components, such as a gas or gas mixture, in the chambers. In one embodiment, the reaction may include the combustion of one or more components in the chambers. In one embodiment, the reaction may include the ignition of one or more components in the chambers using a heat source, an ignition source, and/or when subjected to a pressurized environment. The one or more first and second components may include one or more combinations of the following items provided in the list of components recited near the end of the detailed description.

In one embodiment, one or more components may be combined in the chambers to form a compound, such as hydrogen. The compound may then be ignited, such as with an ignition source, to generate a rapid pressure increase. The rapid pressure increase may act on the pistons to release their engagement from the piston subs. The pressure in the chambers may then be communicated to the setting tool.

In one embodiment, a barrier member may be provided in place of the pistons and piston subs of the accumulator systems 300 and 400. The chambers 325 and 465 may be filled with a pre-determined amount of fluid pressure configured to actuate the setting tool. A component may be introduced into the chambers, which is configured to dissolve the barrier member and open fluid communication to the setting tool.

In one embodiment, the assembly 100 may include a jarring tool, an accumulator system, a setting tool, and one or more wellbore tools. The jarring tool may be any wellbore tool known by one of ordinary skill in the art that is configured to deliver an impact load to another assembly component. The jarring tool may be connected to one end of the accumulator system, which may be connected to one end of the setting tool. The accumulator system may be pre-filled with an amount of fluid pressure configured to actuate the setting tool. The jarring tool may be configured to supply an impact load to the accumulator system sufficient to actuate the accumulator system to release the fluid pressure to the setting tool.

In one embodiment, the assembly having the jarring tool may include the accumulator systems 300 and/or 400. The chambers 325 and 465 may be filled with a pre-determined amount of fluid pressure configured to actuate the setting tool. The jarring tool may be configured to provide an impacting force to the accumulator systems, such as to the upper subs 310 and 410, sufficient to cause the releasable members 345 and 445 to release the pistons 340 and 440. The fluid pressure may then move the pistons to open fluid communication to the ports 347 and 447 around the seals 314 and 317. The fluid pressure may be communicated to the setting tool via the ports 347 and 447 and the bores of the lower subs 350 and 450.

In one embodiment, the accumulator systems 300 and/or 400 may include a rupture disk in place of the pistons 340 and 440 and the piston subs 330 and 430. In one embodiment, the rupture disk may be configured to break when the chambers 325 and 465 are pressurized to a pre-determined amount by the pump. In one embodiment, the chambers 325 and 465 may be pre-filled with an amount of fluid pressure configured to actuate the setting tool. In one embodiment, the jarring tool may be configured to provide an impacting force to the accumulator system, such as to the upper subs 310 and 410, sufficient to cause the rupture disk to break and open fluid communication to the setting tool. In one embodiment, the accumulator systems 300 and 400 may further include a member, such as a rod, configured to break the rupture disk upon impact by the jarring tool.

In one embodiment, one or more of the accumulator systems described herein may be configured to be in fluid communication with the annulus of the wellbore surrounding the system. For example, a port may be provided in the accumulator system that permits fluid communication from the annulus of the wellbore to the bore and/or one or more chambers of the accumulator system. A valve, such as a one-way valve, a check valve, a flapper valve, or other similar valve component may be connected to the port to prevent fluid communication from the accumulator system to the annulus of the wellbore. The annulus of the wellbore may be pressurized from the surface of the wellbore to pressurize and/or re-fill the accumulator system. The accumulator system may then be actuated to supply the pressure to the setting tool 80. The setting tool 80 may be acutated using the pressure to actuate the downhole tool 90. The accumulator system may be re-pressurized and/or filled via the annulus.

In one embodiment, one or more of the accumulator systems described herein may be operable to be releasable from the portion of the assembly 100 above the accumulator system, such as by a shearable connection. The upper end of the accumulator system may be configured with a seal assembly, such as a seal receptacle. When the portion of the assembly 100 above the accumulator system is released and removed from the wellbore, the upper end of the accumulator system and the seal assembly may be exposed for re-connection as necessary. A tubular assembly, such as a coil unit or a drill pipe, may be lowered into the wellbore and reconnected with the accumulator system via the seal assembly. The tubular assembly may be used to re-pressurize and/or re-fill the accumulator system from the surface of the wellbore.

Figure 5:
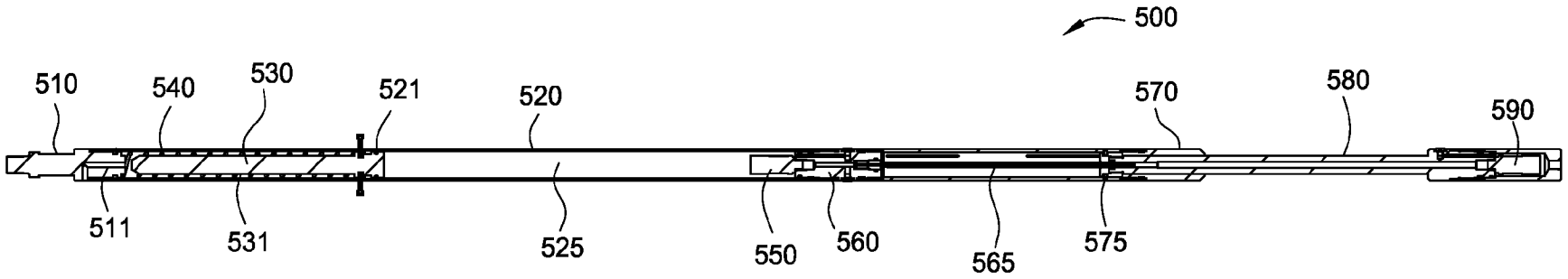
FIG. 5 illustrates a sectional view of a pump according to one embodiment.

FIG. 5 illustrates a cross-sectional view of a pump 500 according to one embodiment. The pump 500 includes an upper sub 510, a piston housing 520, a piston member 530, a biasing member 540, a first valve assembly 550, a connection member 560, an upper mandrel 570, a lower mandrel 580, and a second valve assembly 590. The upper sub 510 may include a cylindrical member configured to connect the pump to the weight stem 40, such as by a threaded connection. The upper sub 510 may be connected to the piston housing 520, such as by a threaded connection. The piston housing 520 may include a cylindrical member having a bore disposed through the body of the member, in which the piston member 530 is sealingly and movably disposed. The piston member 530 may include a cylindrical member that is surrounded by the biasing member 540. The biasing member 540 may include a spring configured to bias the piston member 530 away from the bottom end of the upper sub 510. The upper sub 510 may also include a port 511 configured to allow wellbore fluids into and out of a chamber 531 disposed above a portion of the piston member 530. One or more seals 521, such as o-rings, may be provided at the interface between the piston member 530 and piston housing 520 to seal the chamber 531 above the piston member 530.

A chamber 525 is formed below the piston member 530 in the bore of the piston housing 520 and may be pre-filled with a fluid, such as a hydraulic fluid. In one embodiment, the fluid may include oil and/or water. The chamber 525 may be sealed at one end by the piston member 530 and at the opposite end by the connection member 560. The connection member 560 may include a cylindrical member having a bore disposed through the member. The connection member 560 may be connected to the piston housing 520, such as by a threaded connection. The first valve assembly 550 may be connected to the connection member 560 and is configured to control fluid communication between the chamber 525 and the bore of the connection member 560. The connection member 560 may also be connected to the upper mandrel 570, such as by a threaded connection. The upper mandrel 570 may include a cylindrical member having a bore dispose through the body of the member. The upper mandrel 570 may be releasably connected to the lower mandrel 580 by a releasable member 575, such as a shear screw, a collet, a latch, or other similar releasable component. The lower mandrel 580 may include a cylindrical member having a bore disposed through the body of the member. The lower end of the mandrel 580 may be configured to connect the pump 500 to the anchor 60 of the assembly 100, such as by a threaded connection. The second valve assembly 590 may be disposed in the lower mandrel 580 and configured to control fluid communication between pump 500 and the remainder of the assembly 100 below the pump 500 as described above.

A plunger member 565 is connected at one end to the connection member 560 and extends into the bore of the lower mandrel 580. The plunger member 565 may include a cylindrical member having a bore disposed through the body of the member. The bore of the plunger member 656 provides fluid communication from the bore of the connection member 560 to the bore of the lower mandrel 580. The plunger member 565 may be extended into and out of the bore of the lower mandrel 580 by movement of the connection member 560 relative to the lower mandrel 580. The upper sub 510, the piston housing 520, the piston member 530, the connection member 560, the upper mandrel 570, and the plunger member 565 may each move relative to the lower mandrel 580 after release of the releasable member 575.

The first valve assembly 550 may be configured to permit fluid communication from the chamber 525 to the bores of the connection member 560, the plunger member 565, and the lower mandrel 575, while preventing fluid communication into the chamber 525. In one embodiment, the first valve assembly 550 may include a one-way check valve. The first valve assembly 550 may be configured to open fluid communication from the chamber 525 when the pressure in the chamber 525 exceeds the pressure below the first valve assembly 550. In one embodiment, the first valve assembly 550 may be configured to open fluid communication from the chamber 525 when the pressure in the chamber 525 exceeds the pressure below the first valve assembly 550 by more than about 5 psi.

The second valve assembly 590 may be configured to permit fluid communication from the bores of the connection member 560, the plunger member 565, and the lower mandrel 575 to the accumulator system 70 while preventing fluid communication in the reverse direction. In one embodiment, the second valve assembly 590 may include a one-way check valve. The second valve assembly 590 may be configured to open fluid communication from the pump 500 when the pressure in the bores of the connection member 560, the plunger member 565, and the lower mandrel 575 exceeds the pressure below the second valve assembly 590. In one embodiment, the second valve assembly 590 may be configured to open fluid communication from the pump 500 when the pressure in the bores of the connection member 560, the plunger member 565, and the lower mandrel 575 exceeds the pressure below the second valve assembly 590 by more than about 100 psi.

In operation, the assembly 100 may be lowered into the wellbore on the slickline 30 and secured in the wellbore by the anchor 60. After the assembly 100 is secured in the wellbore, the weight of the weight stem 40 may be set down on the pump 500 and used to release the releasable member 575. After release of the releasable member 575, the pump 500 may be stroked downward using the weight stem 40 to pump a portion of the fluid in the chamber 525 to the accumulator system 70. In particular, the wellbore pressure in the chamber 531 and/or the force provided by the biasing member 540 may be used to pressurize the fluid in the chamber 525 to open fluid communication through the first valve assembly 560. A portion of the fluid in the chamber 525 may flow into the volume of space formed by the bores of the connection member 560, the plunger member 565, and the lower mandrel 580 above the second valve assembly 590. The column of fluid situated in the bores of the connection member 560, the plunger member 565, and the lower mandrel 580 may be pressurized to open fluid communication through the second valve assembly 590 by a downward stroke of the plunger member 565 into the bore of the lower mandrel 580 (thereby reducing the volume of space in which the fluid resides). The pump 500 may be stroked until the lower end of the upper mandrel 570 engages a shoulder on the lower end of the lower mandrel 590. The column of fluid may therefore be pumped into the accumulator system 70. The pump 500 may be reset by pulling upward on the slickline 30 to relieve the weight of the weight stem 40 and retract the upper components of the pump 500 relative to the lower mandrel 580. The pump 500 may then be stroked downward again using the weight stem 40. The pump 500 may be repeatedly cycled to pressurize the accumulator system 70 as described above. In one embodiment, a continuous spooled rod, such as COROD®, may be used as the conveyance. The continuous spooled rod may be configured to facilitate operation of the assembly 100, including actuation of the pump 500 and/or the anchor 60 as described herein, and the weight stem 40 may be omitted.

Figure 6:
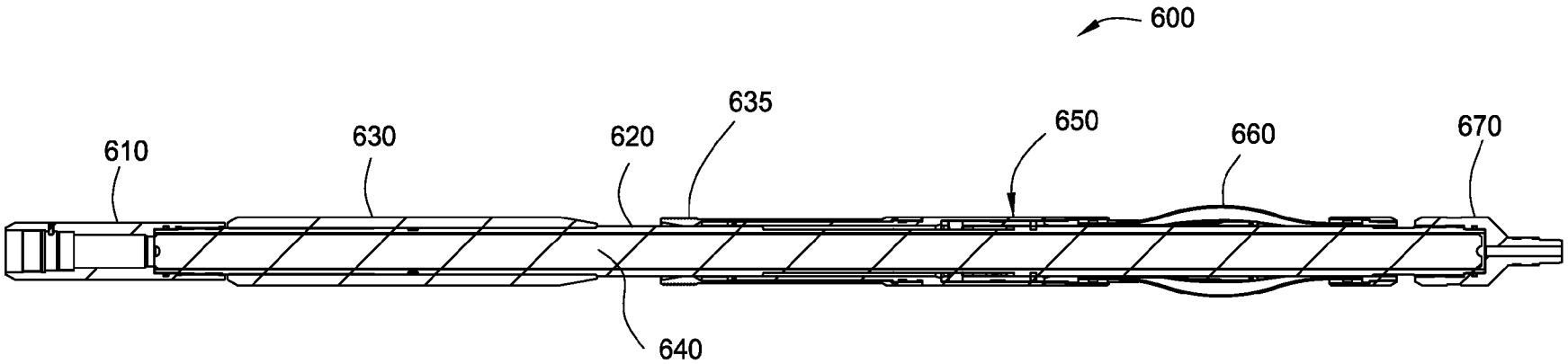
FIG. 6 illustrates a sectional view of an anchor according to one embodiment.

FIG. 6 illustrates a cross-sectional view of an anchor 600 according to one embodiment. The anchor 600 includes an upper sub 610, an inner mandrel 620, a cone member 630, a gripping member 635, a filler member 640, a setting assembly 650, a friction member 660, and a lower sub 670. The upper sub 610 may include a cylindrical member having a bore disposed through the body of the member and is configured to connect the anchor 600 to the pump 50, such as by a threaded connection. The upper sub 610 may also be connected to the inner mandrel 620, such as by a threaded connection. The inner mandrel 620 may include a cylindrical member having a bore disposed through the body of the member, in which the filler member 640 is disposed. The filler member 640 may include a cylindrical member that configured to reduce the volume of space formed by the bore of the inner mandrel 620. The cone member 630 may be connected to the inner mandrel 620 and configured to bias the gripping member 635 into engagement with the surrounding wellbore. In one embodiment, the gripping member 635 may include a plurality of slips. The setting assembly 650 may be connected to the inner mandrel 620 and configured to control the relative movement between the cone member 630 (via the inner mandrel 620) and the gripping member 635. The friction member 660, which may include drag springs, may be movably connected to the outer surface of the inner mandrel 620 and configured to facilitate actuation of the setting assembly 650. The lower sub 670 may be connected to the lower end of the inner mandrel 620, such as by a threaded connection. The lower sub 670 also facilitates connection of the anchor 600 to the accumulator system 70.

In operation, the assembly 100 is lowered into the wellbore using the slickline 30. The friction member 660 of the anchor 600 will engage the wellbore walls and permit relative movement between the inner mandrel 620 and the setting assembly 650. The slickline 30 may be raised and lowered to move the inner mandrel 620 (via the upper sub 610) relative to the setting assembly 650 to actuate the setting assembly 650 into a setting position. When the setting assembly 650 is actuated in the setting position, the inner mandrel 620 is permitted to move a distance relative to the gripping member 635 so that the cone member 630 may bias the gripping member 635 into engagement with the wellbore walls. To move the cone member 630 into engagement with the gripping member 635, the slickline 30 may allow the weight stem 40 and the weight of the assembly 100 above the anchor 600 to set down on the upper sub 610 and move the cone member 630 into engagement with the gripping member 635. The assembly 100 may be placed in compression to secure the anchor 600 and the assembly 100 in the wellbore. When the setting assembly 650 is not in the setting position, the relative movement of the inner mandrel 620 is limited so that the cone member 630 is prevented from engaging the gripping member 635. To unset the anchor 600, the slickline 30 may be raised to move the inner mandrel 620 and thus the cone member 630 from engagement with the gripping member 635 to actuate the anchor 600 out of the setting position. The anchor 600 is configured to allow fluid communication from the pump 50 to the accumulator system 70, through the bores of the upper sub 610, the inner mandrel 620, and the lower sub 670.

Figure 7:
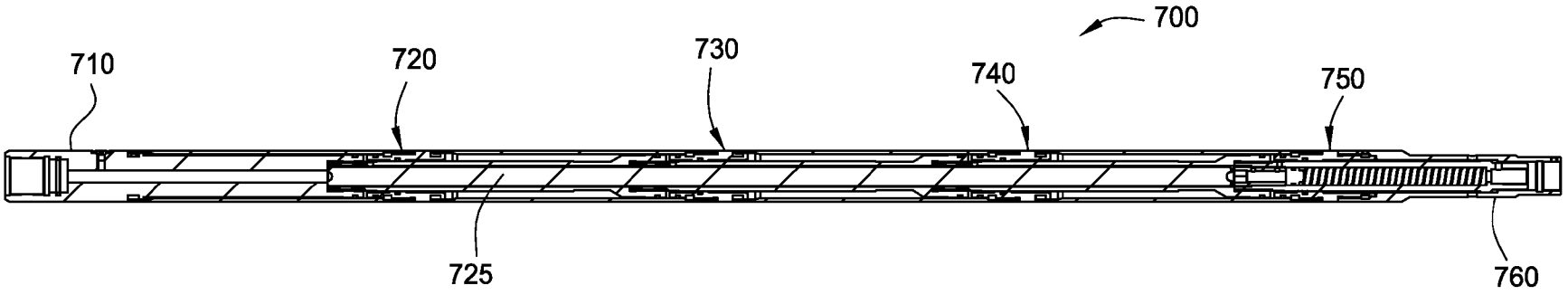
FIG. 7 illustrates a sectional view of a setting tool according to one embodiment.

FIG. 7 illustrates a cross-sectional view of a setting tool 700 according to one embodiment. The setting tool 700 includes an upper sub 710, a filler member 725, one or more piston assemblies 720, 730, and 740, a thermal compensation system 750, and a lower sub 760. The upper sub 710 may include a cylindrical member having a bore disposed through the body of the member and is configured to connect the setting tool 700 to the anchor 60, such as by a threaded connection. The lower sub 760 may include a cylindrical member having a bore disposed through the body of the member and is configured to connect the setting tool 700 to one or more wellbore tools 90, such as by a threaded connection. The filler member 725 may include a cylindrical member that is disposed in an inner mandrel formed by the piston assemblies 720, 730, and 740 and configured to reduce the volume of space formed by the bore of the inner mandrel.

The one or more piston assemblies may each include a piston member, an inner mandrel, and an outer mandrel. The piston assemblies may be connected together, such as by a threaded connection. The piston assemblies may be connected together to form a bore that is in fluid communication with the upper sub 710 and the compensation system 750. The compensation system 750 may include a valve assembly, a biasing member, a releasable member, an inner mandrel, and an outer mandrel. The inner and outer mandrels of the piston assemblies may be connected to the inner and outer mandrels of the compensation system 750, respectively, such as by a threaded connection. The compensation system 750 may be configured to compensate for the thermal expansion of the fluid in the setting tool 700 to prevent premature actuation of the setting tool 700.

In operation, fluid pressure is supplied to the setting tool 700 by the accumulator systems described above. The fluid pressure is communicated through the bore of the upper sub 710 and into the inner mandrel bore formed by the piston assemblies. The inner mandrels of the piston assemblies are in fluid communication with the upper sub 710 via one or more ports configured to direct the fluid pressure to the piston members. The fluid pressure acts on the piston members to move the inner mandrels and the outer mandrels of the piston assemblies and the compensation system relative to each other. In particular, the actuation of the piston members will cause the releasable member of compensation system 750 to release the engagement between the inner and outer mandrels to permit the relative movement. The inner and outer mandrels of the compensation system 750 are each connected to the wellbore tool 90 and are configured to actuate the wellbore tool 90. The inner and outer mandrels are configured to provide a push and/or pull force to the wellbore tool 90 to actuate and set the wellbore tool 90 in the wellbore.

As the setting tool 700 is lowered into the wellbore, the temperature in the wellbore may cause the fluid in the setting tool 700 to expand and increase the pressure in the setting tool 700. This pressure increase may act on the piston assemblies and cause premature actuation of the setting tool 700. The valve assembly and the biasing member, however, may compensate for the thermal expansion. The increase in pressure may act on the valve assembly and compress the biasing member to compensate for the fluid expansion. The biasing member may be configured to compensate for the fluid expansion and prevent premature release of the releasable member of the compensation system.

In one embodiment, the first, second, and/or third components discussed above may include one or more of the following components in a solid, liquid, and/or gaseous state: water, air, oxygen, hydrogen, nitrogen, sodium, sodium tetrahydroborate, sodium hydride, potassium, aluminum, sulfuric acid, nitric acid, hydrochloric acid, zinc, acetic acid, acetic anhydride, acrolein, allyl alcohol, allyl chloride, aniline, aniline acetate, aniline hydrochloride, benzoyl peroxide, cyanic acid, dimethyl keytone, epichlorohydrin, ethylene diamine, ethylene imine, hydrogen peroxide, isoprene, mesityl oxide, acetone cyanohydrin, carbon disulfide, cresol, cumen, diisobutylene, ethylene cyanohydrin, ethylene glycol, hydrofluoric acid, cyanide of sodium, cyclohexanol, cyclohexanone, ethyl alcohol, hydrazine, hydriodic acid, isopropyl ether, and manganese.

In one embodiment, the reaction may be caused by the vaporization of liquid nitrogen. In one embodiment, sodium tetrahydroborate can be used as a component in the reaction to generate hydrogen. In one embodiment, the reaction may be caused by the ignition of hydrogen, wherein the hydrogen may be formed from a combination of zinc and hydrochloric acid. In one embodiment, the reaction may be caused by a combination of aluminum and water to produce hydrogen, which can be ignited to cause a release of energy. In one embodiment the reaction may be caused by a combination of sodium hydride and water to produce hydrogen, which can be ignited to cause a release of energy. In one embodiment, the components may comprise a liquid metal sodium-potassium alloy, water, and air to generate the reaction.

In one embodiment, the first, second, and/or third component may include sulfuric acid and/or nitric acid, and one or more of the following components: acetic acid, acetic anhydride, acrolein, allyl alcohol, allyl chloride, aniline, aniline acetate, aniline hydrochloride, benzoyl peroxide, cyanic acid, chlorosulfonic acid, dimethyl keytone, epichlorohydrin, ethylene diamine, ethylene imine, hydrogen peroxide, isoprene, mesityl oxide, acetone cyanohydrin, carbon disulfide, cresol, cumen, diisobutylene, ethylene cyanohydrin, ethylene glycol, hydrofluoric acid, cyanide of sodium, cyclohexanol, cyclohexanone, ethyl alcohol, hydrazine, hydriodic acid, isopropyl ether, and manganese.

Table 1 illustrates a list of reactants that can be used as the first, second, and/or third components discussed above.

TABLE 1

| Reactant A | Reactant B |
|---|---|
| Acetic acid | Chromic acid, nitric acid, hydroxyl compounds, ethylene glycol, perchloricacid, peroxides, permanganates |
| Acetone | Concentrated nitric and sulfuric acid mixtures |
| Acetylene | Chlorine, bromine, copper, fluorine, silver, mercury |
| Alkali and alkaline earth metals (lithium, sodium, potassium) | Water, carbon tetrachloride or other chlorinated hydrocarbons, carbon dioxide, halogens, powdered metals (e.g., aluminum or magnesium) |
| Ammonia (anhydrous) | Mercury (e.g., in manometers), chlorine, calcium hypochlorite, iodine, bromine, hydrofluoric acid (anhydrous) |
| Ammonium nitrate | Acids, powdered metals, flammable liquids, chlorates, nitrates, sulfur, finely divided organic or combustible materials |
| Aniline | Nitric acid, hydrogen peroxide |
| Arsenical materials | Any reducing agent |
| Azides | Acids |
| Bromine | See Chlorine |
| Calcium oxide | Water |
| Carbon (activated) | Calcium hypochlorite, all oxidizing agents |
| Carbon tetrachloride | Sodium, Chlorates, Ammonium salts, acids, powdered metals, sulfur, finely divided organic or combustible materials |
| Chlorine | Ammonia, acetylene, butadiene, butane, methane, propane (or other petroleum gases), hydrogen, sodium carbide, benzene, finely divided metals, turpentine |
| Chlorine dioxide | Ammonia, methane, phosphine, hydrogen sulfide |
| Chromic acid and chromium | Acetic acid, naphthalene, camphor, glycerol, alcohol, flammable liquids in general |
| Copper | Acetylene, hydrogen peroxide |
| Cumene hydroperoxide | Acids (organic or inorganic) |
| Cyanides | Acids |
| Flammable liquids | Ammonium nitrate, chromatic acid, hydrogen peroxide, nitric acid, sodium peroxide, halogens |

TABLE 1-continued

| Reactant A | Reactant B |
|---|---|
| Fluorine | Isolate from everything |
| Hydrocarbons (e.g., butane, propane, benzene) | Fluorine, chlorine, bromine, chromic acid, sodium peroxide |
| Hydrocyanic acid | Nitric acid, alkali |
| Hydrofluoric acid (anhydrous) | Ammonia (aqueous or anhydrous) |
| Hydrogen peroxide | Copper, chromium, iron, most metals or their salts, alcohols, acetone, organic materials, aniline, nitromethane, combustible materials |
| Hydrogen sulfide | Fuming nitric acid, oxidizing gases |
| Hypochlorites | Acids, activated carbon |
| Iodine | Acetylene, ammonia (aqueous or anhydrous), hydrogen |
| Mercury | Acetylene, fulminic acid, ammonia |
| Nitrates | Sulfuric acid |
| Nitric acid (concentrated) | Acetic acid, aniline, chromic acid, hydrocyanic acid, hydrogen sulfide, flammable liquids, flammable gases, copper, brass, any heavy metals |
| Nitrites | Potassium or sodium cyanide. |
| Nitroparaffins | Inorganic bases, amines |
| Oxalic acid | Silver, mercury |
| Oxygen | Oils, grease, hydrogen, flammable: liquids, solids, or gases |
| Perchloric acid | Acetic anhydride, bismuth and its alloys, alcohol, paper, wood, grease, oils |
| Peroxides, Organic | Acids (organic or mineral), avoid friction, store cold |
| Phosphorus (white) | Air, oxygen, alkalis, reducing agents |
| Phosphorus pentoxide | Water |
| Potassium | Carbon tetrachloride, carbon dioxide, water |
| Potassium chlorate | Sulfuric and other acids |
| Potassium perchlorate | (see Sulfuric and other acids also chlorates) |
| Potassium permanganate | Glycerol, ethylene glycol, benzaldehyde, sulfuric acid |
| Selenides | Reducing agents |
| Silver | Acetylene, oxalic acid, tartaric acid, ammonium compounds, fulminic acid |
| Sodium | Carbon tetrachloride, carbon dioxide, water |
| Sodium Chlorate | Acids, ammonium salts, oxidizable materials, sulfur |
| Sodium nitrite | Ammonium nitrate and other ammonium salts |
| Sodium peroxide | Ethyl or methyl alcohol, glacial acetic acid, acetic anhydride, benzaldehyde, carbon disulfide, glycerin, ethylene glycol, ethyl acetate, methyl acetate, furfural |
| Sulfides | Acids |
| Sulfuric acid | Potassium chlorate, potassium perchlorate, potassium permanganate (similar compounds of light metals, such as sodium, lithium) |
| Tellurides | Reducing agents |
| Water | Acetyl chloride, alkaline and alkaline earth metals, their hydrides and oxides, barium peroxide, carbides, chromic acid, phosphorous oxychloride, phosphorous pentachloride, phosphorous pentoxide, sulfuric acid, sulfur trioxide |

Table 2 illustrates a list of a combination of reactants that can be used as the first, second, and/or third components discussed above, and the reaction caused by the mixture of the reactants.

TABLE 2

| Reactants A and B | Potential Reaction |
|---|---|
| Acetic Acid-Acetaldehyde | Small amounts of acetic acid will cause the acetaldehyde to polymerize releasing great quantities of heat. |
| Acetic Anhydride-Acetaldehyde | Reaction can be violently explosive. |
| Aluminum Metal-Ammonium Nitrate | A Potential Explosive |
| Aluminum-Bromine Vapor | Unstable nitrogen tribromide is formed: explosion may result. |

TABLE 2-continued

| Reactants A and B | Potential Reaction |
|---|---|
| Ammonium Nitrate-Acetic Acid | Mixture may result in ignition, especially if acetic acid in concentrated. |
| Cupric Sulfide-Cadmium Chlorate | Will explode on contact. |
| Hydrogen Peroxide-Ferrous Sulfide | A vigorous, highly exothermic reaction. |
| Hydrogen Peroxide-Lead II or IV Oxide | A violent, possibly explosive reaction. |
| Lead Sulfide-Hydrogen Peroxide | Vigorous, potentially explosive reaction. |
| Lead Perchlorate-Methyl Alcohol | An explosive mixture when agitated. |
| Mercury II Nitrate-Methanol | May form Hg fulminate-an explosive. |
| Nitric Acid-Phosphorous | Phosphorous aburns spontaneously in presence of nitric acid. |
| Potassium Cyanide-Potassium Peroxide | A potentially explosive mixture if heated. |
| Sodium Nitrate-Sodium Thiosulfate. | A mixture of the dry materials may result in explosion. |

While the foregoing is directed to embodiments of the invention, other and further embodiments of the invention may be devised without departing from the basic scope thereof, and the scope thereof is determined by the claims that follow.

We claim:

1. A wellbore assembly, comprising:

a conveyance member;

an accumulator system connected to the conveyance member;

a pump connected to the conveyance member and configured to pump fluid into a chamber of the accumulator system;

a valve disposed between the pump and the accumulator system configured to allow fluid flow into the chamber; and a setting tool connected to the accumulator system, wherein the accumulator system includes a piston movable from a first position that closes fluid communication between the chamber and the setting tool, to a second position that opens fluid communication through one or more ports of the piston to supply pressurized fluid from the chamber to actuate the setting tool.

2. The assembly of claim 1, wherein the conveyance member includes at least one of a continuous spooled rod, a wireline, and a slickline.

3. The assembly of claim 1, further comprising a weighted member connected to the conveyance member, wherein the weighted member is moveable using the conveyance member to actuate the pump to pump fluid into the accumulator system.

4. The assembly of claim 1, further comprising an anchor connected to the accumulator system and configured to secure the assembly in a wellbore.

5. The assembly of claim 1, further comprising a wellbore tool connected to the setting tool, wherein the setting tool is configured to actuate the wellbore tool upon actuation by the pressurized fluid.

6. The assembly of claim 5, wherein the wellbore tool includes a packer assembly.

7. The assembly of claim 1, further comprising a jarring tool connected to the accumulator system and configured to actuate the accumulator system to supply the pressurized fluid to the setting tool.

8. The assembly of claim 1, wherein the accumulator system is pre-filled with pressurized fluid.

9. The assembly of claim 1, wherein the pressurized fluid is generated from a hydraulic fluid that is pressurized in the chamber.

10. The assembly of claim 1, wherein the accumulator system is re-settable downhole to supply a subsequent amount of pressurized fluid to actuate the setting tool, wherein the subsequent amount of pressurized fluid has a pressure equal to, greater than, or less than the pressure of the pressurized fluid.

11. The assembly of claim 1, further comprising a biasing member configured to bias the piston into the first position.

12. The assembly of claim 1, further comprising a releasable member configured to secure the piston in the first position, wherein the releasable member is configured to release the piston out of the first position to open fluid communication to the setting tool.

13. The assembly of claim 1, wherein the pump is repeatedly cycled to pump fluid into the accumulator system prior to the piston moving to the second position to open fluid communication through the one or more ports of the piston to actuate the setting tool.

14. A method of operating a wellbore tool, comprising:

lowering a wellbore assembly into a wellbore using a conveyance member, wherein the wellbore assembly includes a pump, an accumulator system, a valve configured to allow fluid flow into the accumulator system, and a setting tool;

actuating the pump to pump fluid into the accumulator system;

actuating the accumulator system by moving a member piston from a first position that closes fluid communication between the accumulator system and the setting tool, to a second position that opens fluid communication through one or more ports of the piston to supply pressurized fluid from the accumulator system to the setting tool;

actuating the setting tool using the pressurized fluid; and operating the wellbore tool.

15. The method of claim 14, wherein the conveyance member includes at least one of a continuous spooled rod, a wireline, and a slickline.

16. The method of claim 14, further comprising pumping fluid into the accumulator system using the pump to generate the pressurized fluid in the accumulator.

17. The method of claim 14, further comprising raising and lowering a weighted member using the conveyance member to actuate the pump to pump the fluid into the accumulator system.

18. The method of claim 14, wherein the fluid is a hydraulic fluid.

19. The method of claim 14, further comprising filling the accumulator system with a fluid prior to lowering the wellbore assembly in the wellbore.

20. The method of claim 19, wherein the fluid is a gas.

21. The method of claim 14, further comprising anchoring the wellbore assembly in the wellbore.

22. The method of claim 14, further comprising operating the wellbore tool using the setting tool upon actuation by the pressurized fluid.

23. The method of claim 14, further comprising generating a reaction to cause a rapid increase in fluid pressure in the accumulator system.

24. The method of claim 23, further comprising mixing fluids in the accumulator system to generate the reaction.

25. The method of claim 14, further comprising pressurizing the accumulator system to actuate the accumulator system.

26. The method of claim 14, further comprising impacting the accumulator system to actuate the accumulator system.

27. The method of claim 14, further comprising resetting the accumulator system downhole to provide a subsequent amount of pressurized fluid to the setting tool that has a pressure equal to, greater than, or less than the pressure of the pressurized fluid that was previously supplied.

28. The method of claim 14, further comprising actuating the accumulator system a second time to re-actuate the setting tool using a subsequent amount of pressurized fluid having a pressure that is equal to, greater than, or less than the pressure of the pressurized fluid that was previously supplied.

29. The method of claim 14, further comprising re-pressurizing the accumulator system to provide a subsequent amount of pressurized fluid to the setting tool that has a pressure equal to, greater than, or less than the pressure of the pressurized fluid that was previously supplied.

30. The method of claim 14, further comprising pressurizing the accumulator system using fluid located in the wellbore to generate the pressurized fluid.

31. The method of claim 14, further comprising biasing the piston into the first position.

32. The method of claim 14, further comprising securing the piston in the first position using a releasable member, and releasing the releasable member to release the piston out of the first position to open fluid communication to the setting tool.

33. The method of claim 14, further comprising repeatedly cycling the pump to pump fluid into the accumulator system prior to opening fluid communication through the one or more ports of the piston to actuate the setting tool.

34. An accumulator system, comprising:

a body having a bore disposed through the body, wherein the bore is filled with a fluid;

a valve configured to allow fluid flow into the bore at an upper end;

a piston configured to seal the bore at a lower end, wherein the piston includes a piston member having one or more ports formed through the piston member, and wherein the piston member is movable between a closed position and an open position;

a biasing member configured to bias the piston member into the closed position to seal the lower end of the bore; and a releasable member configured to secure the piston member to the body, wherein the releasable member is configured to release the piston member from the body into the open position to permit fluid communication through the lower end of the bore.

35. The system of claim 34, wherein the valve is configured to permit fluid communication into the upper end of the bore and prevent fluid communication out of the upper end of the bore.

36. The system of claim 34, wherein the releasable member is a lock ring configured to release the piston member from the body when the bore is pressurized by a hydraulic pressure.

37. The system of claim 34, further comprising an inner mandrel disposed in the body forming an outer chamber and an inner chamber in the bore.

38. The system of claim 37, wherein the outer chamber is filled with fluid that is the same as or different than fluid filled in the inner chamber.

39. The system of claim 38, further comprising a piston assembly configured to pressurize fluid disposed in the inner chamber to act on the piston.

40. The system of claim 39, wherein the piston assembly includes a second piston member sealingly disposed between the inner mandrel and the body; and a second biasing member configured to bias the second piston member against fluid disposed in the inner chamber.

41. The system of claim 34, wherein the piston and/or the releasable member are resettable downhole by the biasing member to close fluid communication through the second end of the bore.

42. The system of claim 34, wherein the biasing member comprises at least one of a gas and a spring.

43. A method of operating a wellbore tool, comprising:

lowering a wellbore assembly into a wellbore using a conveyance member, wherein the wellbore assembly includes an accumulator system and a setting tool;

combining a first component with a second component in a chamber of the accumulator system to generate a first reaction;

generating a first rapid pressure increase from the first reaction;

actuating the setting tool using the first rapid pressure increase;

repeating the step of combining the first component with a second component in the chamber to generate a second reaction;

generating a second rapid pressure increase from the second reaction;

actuating the setting tool using the second rapid pressure increase; and operating the wellbore tool.

44. The method of claim 43, wherein the first component and the second component include at least one of a liquid component, a solid component, and a gaseous component.

45. The method of claim 43, wherein the first component and the second component are pre-filled in the accumulator system.

46. The method of claim 43, further comprising combining the first component and the second component to generate additional reactions.

47. An accumulator system, comprising:

a body having a bore disposed through the body, wherein the bore is filled with a fluid;

an inner mandrel disposed in the body forming an outer chamber and an inner chamber, wherein the outer chamber is filled with the fluid;

a valve configured to seal the bore at a first end;

a piston configured to seal the bore at a second end, wherein the piston includes a piston member having one or more ports formed through the piston member, and wherein the piston member is movable between a closed position and an open position;

a biasing member configured to bias the piston member into the closed position to seal the second end of the bore; and a releasable member configured to secure the piston member to the body, wherein the releasable member is configured to release the piston member from the body into the open position to permit fluid communication through the second end of the bore.

48. The system of claim 47, further comprising a piston assembly configured to pressurize fluid disposed in the inner chamber to act on the piston.

49. The system of claim 48, wherein the piston assembly includes a second piston member sealingly disposed between the inner mandrel and the body; and a second biasing member configured to bias the second piston member against fluid disposed in the inner chamber.

50. An accumulator system, comprising:

a body having a bore disposed through the body, wherein the bore is filled with a fluid;

a valve configured to seal the bore at a first end;

a piston configured to seal the bore at a second end, wherein the piston includes a piston member having one or more ports formed through the piston member, and wherein the piston member is movable between a closed position and an open position;

a biasing member configured to bias the piston member into the closed position to seal the second end of the bore; and a releasable member configured to secure the piston member to the body, wherein the releasable member is configured to release the piston member from the body into the open position to permit fluid communication through the second end of the bore, wherein the piston and/or the releasable member are resettable downhole by the biasing member to close fluid communication through the second end of the bore.

51. A wellbore assembly, comprising:

a conveyance member;

an accumulator system connected to the conveyance member;

a pump connected to the conveyance member and configured to pump fluid into the accumulator system; and a setting tool connected to the accumulator system, wherein the accumulator system is configured to supply pressurized fluid to actuate the setting tool and includes a piston configured to generate pressurized fluid within the accumulator system prior to supplying any fluid into the setting tool, wherein the accumulator system is resettable downhole to supply a subsequent amount of pressurized fluid to actuate the setting tool, and wherein the subsequent amount of pressurized fluid has a pressure that is equal to, greater than, or less than the pressure of the pressurized fluid that was previously supplied, and wherein the pump is repeatedly cycled to pump fluid into the accumulator system prior to supplying any pressurized fluid to actuate the setting tool.

52. A method of operating a wellbore tool, comprising:

lowering a wellbore assembly into a wellbore using a conveyance member, wherein the wellbore assembly includes a pump, an accumulator system, and a setting tool;

pumping fluid into the accumulator system to generate pressurized fluid within the accumulator system prior to pumping any fluid into the setting tool, wherein the pump is repeatedly cycled to pump fluid into the accumulator system prior to pumping any fluid into the setting tool;

actuating the accumulator system to supply pressurized fluid to the setting tool;

actuating the setting tool using the pressured fluid;

resetting the accumulator system downhole to provide a subsequent amount of pressurized fluid to the setting tool, the subsequent amount of pressurized fluid having a pressure that is equal to, greater than, or less than the pressure of the pressurized fluid that was previously supplied; and actuating the wellbore tool using the setting tool.

53. A method of operating a wellbore tool, comprising:

lowering a wellbore assembly into a wellbore using a conveyance member, wherein the wellbore assembly includes a pump, an accumulator system, and a setting tool;

actuating the pump to pump wellbore fluid from the wellbore into the accumulator system to pressurize the accumulator system, wherein the pump is repeatedly cycled to pump wellbore fluid into the accumulator system prior to supplying any wellbore fluid to actuate the setting tool;

actuating the accumulator system to provide the wellbore fluid to the setting tool; and actuating the setting tool using the wellbore fluid to actuate the wellbore tool.

54. The method of claim 53, further comprising raising and lowering a weighted member using the conveyance member to actuate the pump to pump the wellbore fluid from the wellbore into the accumulator system.

* * * * *

UNITED STATES PATENT AND TRADEMARK OFFICE

CERTIFICATE OF CORRECTION

PATENT NO. : 8,931,569 B2
APPLICATION NO. : 12/939873
DATED : January 13, 2015
INVENTOR(S) : Fagley, IV et al.

It is certified that error appears in the above-identified patent and that said Letters Patent is hereby corrected as shown below:

Claims:

Column 24, Claim 14, line 28, please delete "member".

Signed and Sealed this
Twenty-third Day of June, 2015

Michelle K. Lee

Michelle K. Lee
*Director of the United States Patent and Trademark Office*